US005909871A

United States Patent [19]

Takehara

[11] Patent Number: 5,909,871

[45] Date of Patent: Jun. 8, 1999

[54] SHEET POST-PROCESSING APPARATUS

[75] Inventor: Yoshifumi Takehara, Yokohama, Japan

[73] Assignee: Canon Kabushiki Kaisha, Tokyo, Japan

[21] Appl. No.: 08/968,849

[22] Filed: Nov. 5, 1997

Related U.S. Application Data

[63] Continuation of application No. 08/545,056, Oct. 19, 1995, abandoned, which is a continuation of application No. 08/324,965, Oct. 18, 1994, abandoned.

[30] Foreign Application Priority Data

Oct. 19, 1993 [JP] Japan ..... 5-284523

[51] Int. Cl.[6] ..... B42B 2/00

[52] U.S. Cl. ..... 270/58.07; 270/58.11; 270/58.14; 355/324

[58] Field of Search ..... 355/324; 270/58.07, 270/58.11, 58.14, 58.18

[56] References Cited

U.S. PATENT DOCUMENTS

| | | | |
|---|---|---|---|
| 5,213,317 | 5/1993 | Mandel | 270/58.11 |
| 5,241,355 | 8/1993 | Yamashita et al. | 270/58.07 X |
| 5,382,012 | 1/1995 | Mandel et al. | 270/58.14 |
| 5,384,634 | 1/1995 | Takehara et al. | 270/58.12 X |

FOREIGN PATENT DOCUMENTS

| | | | |
|---|---|---|---|
| 298510 | 1/1989 | European Pat. Off. . | |
| 58-17063 | 2/1983 | Japan . | |
| 60-223764 | 11/1985 | Japan . | |
| 4-47989 | 2/1992 | Japan . | |
| 4-47991 | 2/1992 | Japan | 270/53 |
| 4-290800 | 10/1992 | Japan . | |

*Primary Examiner*—John T. Kwon

*Attorney, Agent, or Firm*—Fitzpatrick, Cella, Harper & Scinto

[57] ABSTRACT

A sheet post-processing apparatus includes at least one sheet receiving bin for receiving sheets. A sheet discharger discharges sheets into the sheet receiving bins and a post-processor post-processes the sheets stored in the sheet receiving bins. A support supports the sheet discharger, for movement between a first location at a discharging location for discharging the sheets into the sheet receiving bins and a second location at a retracted position away from the first location. A moving device moves the sheet discharging means from the first location to the second location when relative movement is imparted between the sheets and the post-processor so that the post-processor is activated at a predetermined location along the edges of the sheets in the sheet receiving bins.

44 Claims, 26 Drawing Sheets

SHEET POST-PROCESSING APPARATUS

This application is a continuation of application Ser. No. 08/545,056 filed Oct. 19, 1995, now abandoned, which is a continuation of application Ser. No. 08/324,965 filed Oct. 18, 1994, abandoned.

FIELD OF THE INVENTION AND RELATED ART

The present invention relates to a sheet post-processing apparatus. More specifically, it relates to a sheet post-processing apparatus having a function to process sheet material after the sheet material such as copy paper or the like is discharged from an image forming apparatus such as copying machine, printing machine, or laser beam printer, following an image formation operation, and is sequentially sorted and deposited in a receiving tray (hereinafter, "bin tray").

In a conventional sheet post-processing apparatus (hereinafter, "sorter") comprising a binding apparatus (hereinafter, "stapler") which is disposed so as to be enabled to move to or away from the bin, the stapler is caused to invade into the bin region, where the sheets sorted and deposited in the bins are bound, bin after bin, by the stapler.

In an apparatus (FIG. 27) which binds the sheets, at one of the corners, a stapler 700 is disposed on the front side or the like location of the bin B where the sheets are discharged by a discharge roller 980 or the like, wherein the binding apparatus is advanced into the bin space during the binding operation to bind the sheets, at the corner.

In the case of such a configuration, the discharge roller 980, a sheet guiding member 981, or the like are disposed so as to afford a gap 982, so that they do not interfere with the aforementioned stapler 700 during its advance.

In an apparatus which binds the sheets, at two points which are closer to the center portion of the bin stopper side edge, or in an apparatus which binds, at a single point which is near the rear edge, a sheet discharging roller 800 and a sheet guiding member 801 which discharge the sheets into the bin B interfere with the stapler 700; therefore, an additional bin Bc is provided in some apparatuses such as those disclosed in the specifications of Japanese Laid-Open Patent Application No. 290,800/1992, wherein the bin Bc is different from the bin B and the sheets are bound in this bin Bc in coordination with the stapler 700 (FIG. 28).

However, in the case of the conventional apparatus described hereinbefore, the bin interval must be widened above the discharge bin Bb, above the bin Bc in which the sheets are bound, and above the bin Bd which is immediately below the bin Bc; in other words, it is necessary to widen the bin interval at three locations (Y) (in the case of the aforementioned apparatus which binds the sheets at a single corner, the bin interval must be widened at two locations since the bin in which the sheets are discharged and the bin in which the sheets are bound are the same bin).

Therefore, there are the following shortcomings.

(1) Since an extra bin interval must be widened in comparison to the case of the single point binding apparatus, the apparatus height itself must be increased.

(2) The bin into which the sheets are discharged and the bin in which the sheets are bound are different, and therefore, a bin shifting operation must be carried out before the sheets are bound after the sheets are discharged into the bins. As a result, the overall processing time including the binding operation takes up more time.

These problems occur when the sorting operation has been completed in the states as shown in FIGS. 29 and 30 (a reference numeral 800 designates a pair of discharging rollers, and 700 designates a stapler), wherein a three bin setup is illustrated. If the setup is such that the stapler can staple the sheets in the same bin as the one (B3) into which the discharging roller pair discharge the sheets, the bins are required to be shifted a distance equivalent to only two bin intervals in the direction designated by a reference numeral 970, whereas the setup shown in FIG. 29 requires B1 to be moved to a location of Bx, that is, a distance equivalent to three bin intervals (FIG. 29).

In the case of the setup shown in FIG. 30, after the sorting is completed, the bins are shifted in the direction of an arrow 970 to staple the sheets in B1, and then, the sheets in B2 and B3 are stapled as the bins are shifted in the direction of an arrow 971.

Further, referring to FIG. 28, because of the structural restriction, it is difficult to move a top guide roller 43 and a bottom guide roller 42 provided in a bin unit 9, which will be described later in detail, to positions F and G (close to the center portion of a lead cam 40), and therefore, a roller unattached to any bin must be disposed between the top-most bin and the guide roller 43, and between the bottom-most bin and the guide roller 42. As a result, the overall apparatus height must be further increased.

(3) Generally speaking, when the angle of the sheet discharge bin Bb is set at approximately 30°, the sheets can be most properly accumulated. However, in the case of the aforementioned setup, two intervals immediately below the sheet discharge bin are temporarily expanded, affecting the bin angle. The angle of the most affected bin Bd becomes rather steep in comparison to the case of the apparatus in which the discharge bin and stapling bin are the same, creating such a problem that the accumulated sheets are liable to buckle when they are of a large size.

In the case of a known apparatus of a different type, as illustrated in FIG. 31, capable of carrying out various binding operations, the stapler 700 is moved to various positions corresponding to the selected binding mode: the single point front corner binding, two point binding, and single point rear corner binding; therefore, it is moved in the directions indicated by arrows 702A and 702B to positions 700*b* and 700*c* so that it does not interfere with the bins, and then, is moved forward relative to the stapler orientation (directions 701A, 701B, and 701C) to bind the sheets at a predetermined point or points (after the completion of the binding operation, it is moved back in the opposite directions of the arrows).

However, when the sheets are bound at the single front point (with a staple being positioned at a point 703A) using the apparatus described in the foregoing, the stapler 700 which is angled as indicated by a reference numeral 700*a* in FIG. 31 is moved forward in the direction of an arrow 701A to the location 700A in order to bind the sheets; therefore, a width equivalent to a distance 704 which the stapler 700 travels is required, which makes it difficult to reduce the apparatus dimension in the direction of an arrow 790.

Further, when the sheets are bound at the single rear point (sheets are oriented as indicated by a reference symbol S2, and are bound by the stapler positioned at a location 700C, with a staple being positioned at a point 703), the edge Sa of the sheet S2 and staple are generally rendered parallel to each other due to the structural restriction. However, even in the case of the single rear point binding, the staple 703A is preferred to be slanted at an angle of θ relative to the sheet edge Sa as it is in the aforementioned case of the single point front binding, and an apparatus capable of binding in such a manner has been long desired (FIG. 31).

As a known apparatus having such a capability, there is one such as is illustrated in FIG. 32, in which a stapler is supported by rollers 870 or the like, being enabled to move along a rail 871, wherein the sheets are moved in the direction of an arrow 875 and bound by the stapler having been moved to a location 700 G in the drawing.

In order to devise the apparatus mechanism so that the sheets can be bound at a single rear point 876, it is only necessary to form the rail 871 in the shape designated by a reference numeral 871A in the drawing. However, as is evident from the drawing, the location of the sheet edge opposite to an aligning wall 874 varies depending on the sheet size; therefore, when such a structure is employed, it is difficult to handle a situation in which the sheets St are bound at a single rear point, that is, at a position 877, with the staple being slanted, as shown in the drawing.

SUMMARY OF THE INVENTION

The present invention was made in view of the shortcomings of the conventional apparatus described hereinbefore, and its primary object is to provide a sheet post-processing apparatus in which sheet discharging means which discharges the sheets into the sheet receiving bins, and the post-processing means which post-processes, that is, binds, the sets of sheets, are prevented from interfering with each other, so that the sheet sets can be smoothly post-processed.

According to an aspect of the present invention, a sheet post-processing apparatus comprises: at least one sheet receiving bin for storing the sheets; sheet discharging means for discharging the sheets into said sheet receiving bins, and post-processing means for binding the sheets stored in said sheet receiving bins; wherein said sheet discharging means is enabled to move from a first location for discharging the sheets into said sheet receiving bins to a second location which is a predetermined distance away from the first location, and when the sheets and said post-processing means are moved relative to each other so that said post-processing means is activated at a predetermined location along the edges of the sheets in said sheet receiving bins, said post-processing means is activated after it is moved from the first location to the second location.

According to another aspect of the present invention, a sheet post-processing apparatus comprises: at least one sheet receiving bin (hereinafter, "bin") for storing the sheets, sheet discharging means for discharging the sheets, and post-processing means (hereinafter, "stapler") for binding the sheets stored in said sheet receiving bins; wherein said sheet discharging means is enabled to move from a first location for discharging the sheets into said sheet receiving bins to a second location which is a predetermined distance away from the first location, and when said stapler and the sheets are moved relative to each other so that said stapler is activated at a predetermined location along the edges of the sheets in said bins, said sheet discharging means is moved from the first location to the second location.

With the provision of the aforementioned structure, the sheet discharging means and stapler do not interfere with each other even when the sheets are bound, for example, at two points closer to the substantial center portion of the sheet edge, enabling thereby the sheets to be bound right in the same bin into which the sheets are discharged; therefore, in order to accommodate the stapler advance, the bin interval needs to be widened only at two locations, right above and right below the bin into which the sheets are discharged, affording thereby reduction in the overall height of the post-processing apparatus (hereinafter, "sorter"), and in addition, the reduction in the processing time, since stapling can be started without shifting the bins after the sheet discharge.

According to a further aspect of the present invention, when the sheets are stapled at least at one corner, they can be stapled even when said sheet discharging means is at the first location, that is, the sheet discharging location; therefore, it is unnecessary to move the sheet discharging means in the case of the frequently used single point corner binding mode, which in turn makes it possible to increase further the processing speed and reliability of the apparatus.

According to another aspect of the present invention, the stapler is positioned at one of three locations during the binding operation: a first location where the actual stapling operation is performed, with the discharging means having been temporarily moved away from the discharging location to prevent the interference between two means; a second location where the stapler does not interfere with the sheet discharging means positioned at the discharging location; and a third location set up between the first and second locations where the stapler does not interfere with the bins and/or the sheets thereon while the bins are shifted; wherein during the stapling operation for stapling two or more sets of sheets on the bins, the stapler is reciprocated between the first and third locations, which reduces the moving distance of the stapler, reducing substantially the overall processing time.

Further, position detecting means is disposed at the discharging location and the retract location of the discharging means, and also, position detecting means is disposed at the stapling and the stand-by locations of the stapler; wherein (1) when the stapler is at the stapling location, the movement of the discharging means from the retract location to the discharging location is prohibited, and when the discharging means is at the discharging location, the movement of the stapler from the retract location to the stapling location is prohibited.

(2) when the stapler is at the retract location, the movement of the discharging means to the discharging location is permitted, and when the discharging means is at the retract location, the movement of the stapler to the stapling location is permitted.

Since the movements of the discharging means and stapler are regulated as described in the foregoing, they do not interfere with each other, enabling the stapling operation to be smoothly carried out.

Further, the movement of the sheet discharging means from the first location to the second location is directly linked to the movement of the post-processing means, relative to the sheets, for the post-processing operation, with the use of linking-driving means such as a cam or the like; therefore, the moving mechanism is simplified.

Further, an apparatus comprising at least one bin and a stapler for binding the sheets on the bin, further comprises a supporting member for supporting rotatively the stapler, wherein the supporting member is enabled to move substantially in parallel to the sheet edge along which the sheets are stapled, and after the stapler is selectively rotated at a predetermined location adjacent to the sheet edge, the sheets and stapler are moved relative to each other, in the direction substantially perpendicular to the sheet edge. Therefore, when the stapler is moved without moving the sheets during the stapling operation, in particular, when the sheets are stapled at a single corner point with a staple being placed at an angle, the above-described problem on the front side of the apparatus can be reduced, allowing the apparatus to be more compact.

Lastly, since the stapler can be oriented in any angle (with the use of a simple structure), a staple can be struck in at any angle relative to the line of the sheet edge, at either of the sheet corners, even when the sheet size is changed.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described referring to appended drawings.

Figure 1:
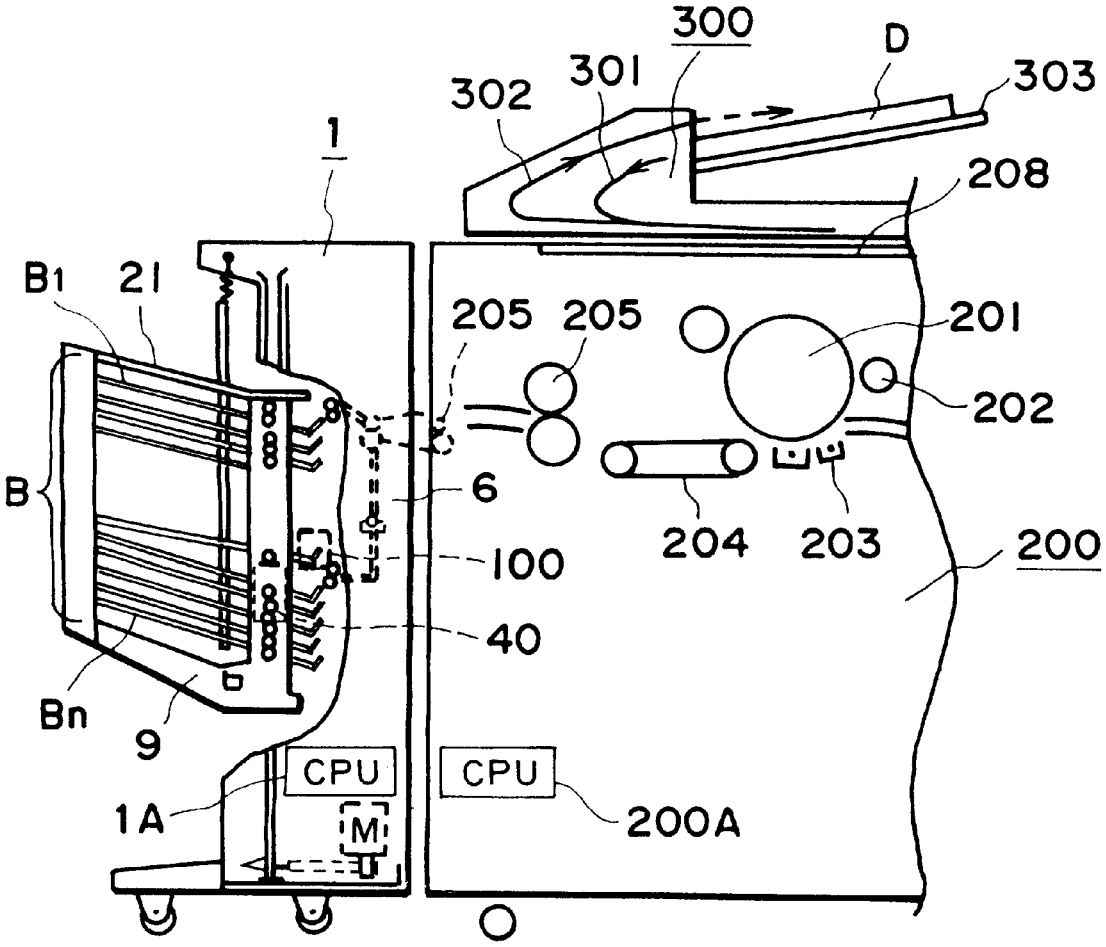
FIG. 1 is a longitudinal section of a sheet post-processing apparatus according to the present invention, and an image forming apparatus employing such a sheet post-processing apparatus.

FIG. 1 gives an overall view of a sheet post-processing apparatus according to the present invention. As shown in FIG. 1, an automatic original feeding apparatus 300, which automatically circulates the originals, is disposed on the top surface of an image forming apparatus 200. A sorting apparatus (hereinafter, "sorter") 1 comprising n pieces of bin trays B (B1, B2, B3–Bn) is disposed on the downstream side the image forming apparatus 200.

The image forming apparatus 200 is one of such that employs a known electro-photographic system, wherein its detailed description will be omitted here. In the apparatus 200, the image on the original positioned on a platen glass 208 is projected on a photosensitive drum 201 by an unillustrated optical system, whereby a latent image is formed on the photosensitive drum 201. This latent image is developed by a developing device 202 disposed around the photosensitive drum 201, and then, the developed image is transferred onto a sheet by a transfer electrode 203. The transferred image is permanently fixed by a fixing device 205.

Figure 2:
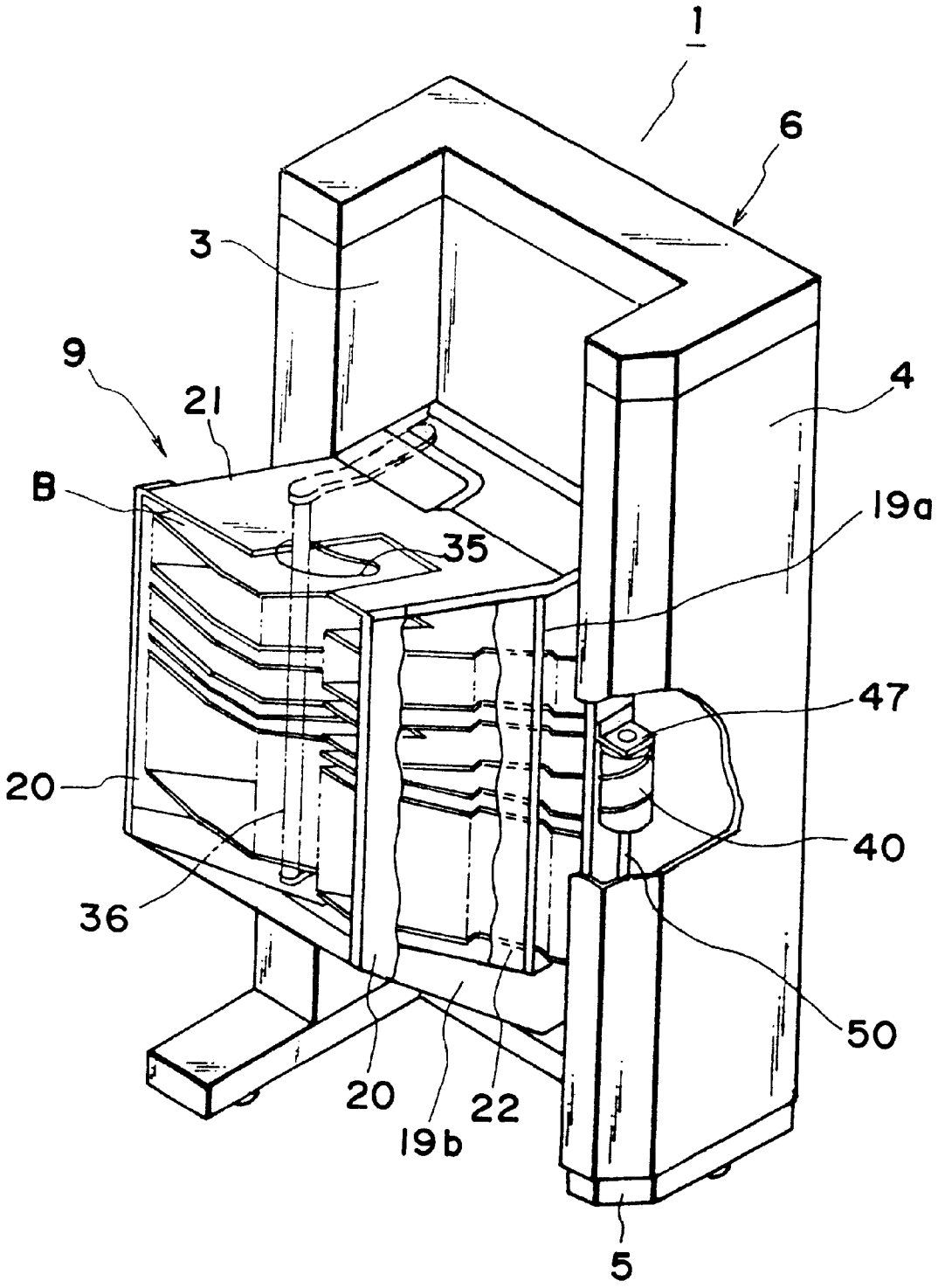
FIG. 2 is an oblique view of the same sheet post-processing apparatus, being partially cut away.
Figure 3:
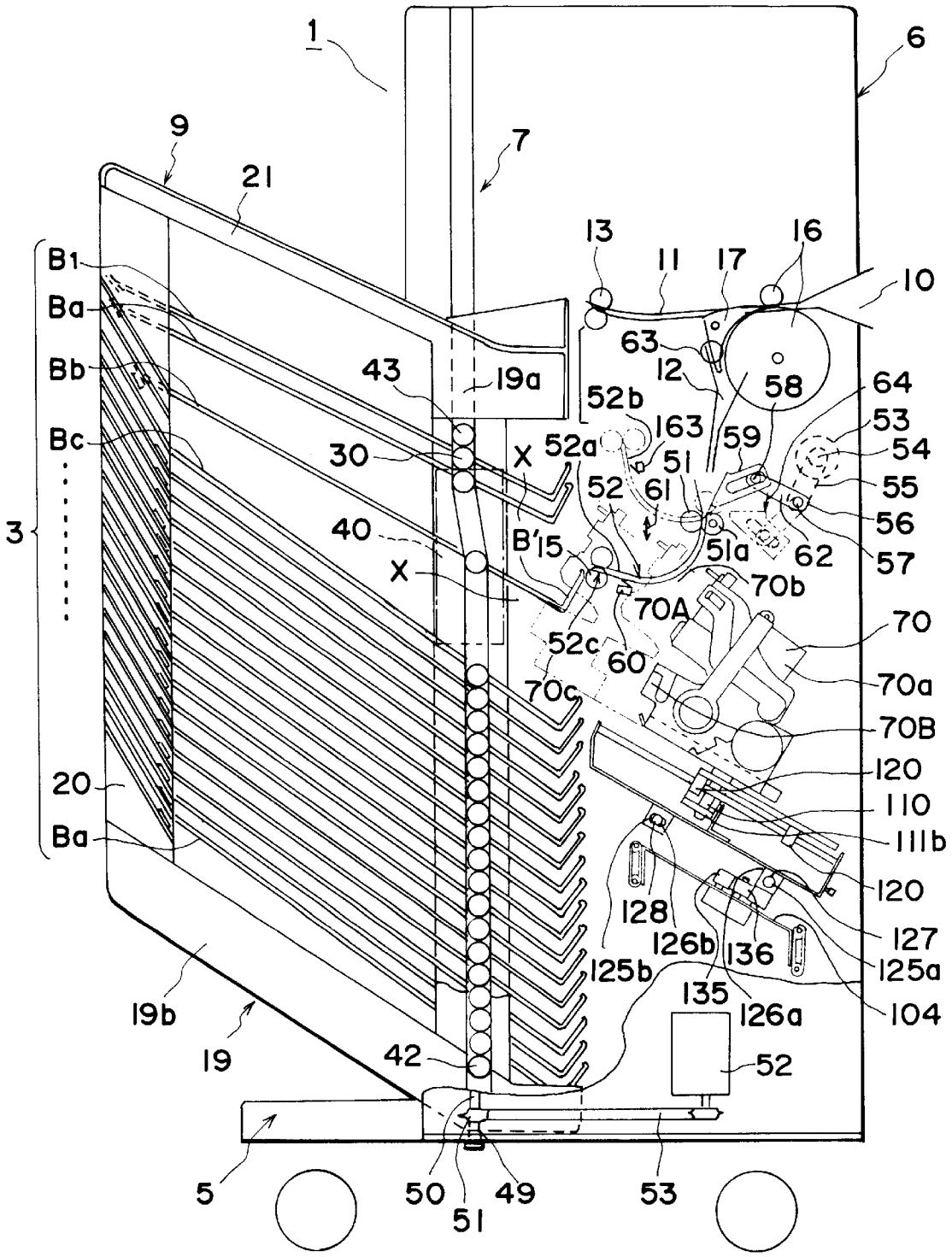
FIG. 3 is a longitudinal section of the same sheet post-processing apparatus.

Referring to FIGS. 2 and 3, the sorter 1 comprises: a sorter main assembly 6 constituted of a pair of front and rear plates 3, a base 5, and a cover 4; and a bin unit 9 which can encase a large number of bins B and move them vertically along a pair of guide rails 7 provided on the sorter main assembly 6, on the front and rear sides, respectively.

The sorter main assembly 6 comprises: a receiving port through which a sheet S discharged from an image forming apparatus such as copying machine is delivered, a first sheet conveying path 11 extending from the receiving port 10 toward the bin unit 9, a sheet conveying path 12 branching from the first sheet conveying path 11, a top pair of discharge rollers 13 for discharging non-sort sheets (sheets which are not sorted), being disposed on the downstream end of the first sheet conveying path 11, and a bottom pair of discharge rollers 15, being disposed at the downstream end of the second sheet conveying path 12 for discharging sorted sheets.

At the portion where the second sheet conveying path 12 branches from the first sheet conveying path 11, a pair of receiving rollers 16 and a deflector 17 are disposed, wherein when a non-sort mode (mode in which the sheets are not sorted) is selected, the deflector 17 is oriented so as to guide the sheet S into the first sheet conveying path 11, and when a sort mode (mode in which the sheets are sorted) is selected, it is oriented so as to guide the sheets S into the second sheet conveying path 12.

Along the sorting path 12, a pair of relaying rollers 51 and a relaying roller 63 are disposed between the receiving roller pair 16 and discharging roller pair 15, at respective strategic locations so that even the sheet having the smallest size (smallest in terms of the dimension in the sheet conveying direction) can be conveyed after their discharge from the main assembly.

Further, the discharging end portion of the sorting path 12 constitutes a movable member (hereinafter, a path end portion 52), wherein the path end portion 52 can be rotated about the axis 51*a*' of a driving roller 51*a*, that is, one of the relaying roller pair 51.

During the normal sheet conveyance, the path end portion 52 is caused to take a position 52*a* illustrated by a solid line, and the tip portion 52*c* of the path end portion 52 is abutted on the abutment portions 6*a* disposed on the side walls, at the respective ends, whereby the position of the path end portion 52 is fixed. Then, this positioning is detected by detecting means 60 such as a microswitch.

The path end portion 52 is rotatable to a location 52*b* illustrated by a double-dot chain line, by driving means 2 described next.

In order to rotate the path end portion 52, a motor 53 is rotated in the counterclockwise direction, and its rotative force is transmitted to a pulley 56 mounted on the rotational axis 57 of a top path rotating lever 62, whereby the lever 62 is rotated in the direction indicated by an arrow mark 64.

A pin 58 located at the tip of the lever 62 engages with a guiding groove 59 provided in the path end portion 52; therefore, the path end portion 52 is rotated in the arrow 61 direction to the location 52*b* as the lever 62 rotates, wherein the detecting means 63 such as a microswitch is disposed at a location which is away from the location 52*a* by a predetermined rotational angle, to detect the presence of the path end portion 52 at the aforementioned location.

In order to move the path end portion 52 back to the previous sheet conveying location, the motor 53 is rotated in reverse, whereby the path end portion 52 is moved to the location 52*a*, where the tip of the path end portion 52*c* is abutted on the abutment portion 62, whereby the position of the path end portion 52 is fixed.

It should be noted that if a torque limiter is provided on the lever rotating axis 57 and the motor 53 is rotated by a predetermined amount of revolutions after the presence of the path end portion 52 is detected by the switch 60 as the tip 52*c* abuts on the abutting portion 6, the path end portion 52 can be accurately positioned (since the path end portion 52 does not move due to the function of the torque limiter, only the rotational axis 57 rotates).

It is needless to say that the abutment portion may be eliminated and the motor may be stopped in response to the detection of the tip portion 52*c* by the detecting means 60.

The bin unit 9 further comprises a bin frame 19 constituted of a pair of front and rear vertical portions 19*a* and 19*b* and a bottom portion 19*b*, wherein a pair of front and rear bin sliders 20 are fixed to the bin frame 19, at the bottom end, and to a bin cover 21, at the top end, along with top end of the vertical portion 19*a* of the bin frame 19.

Figure 4:
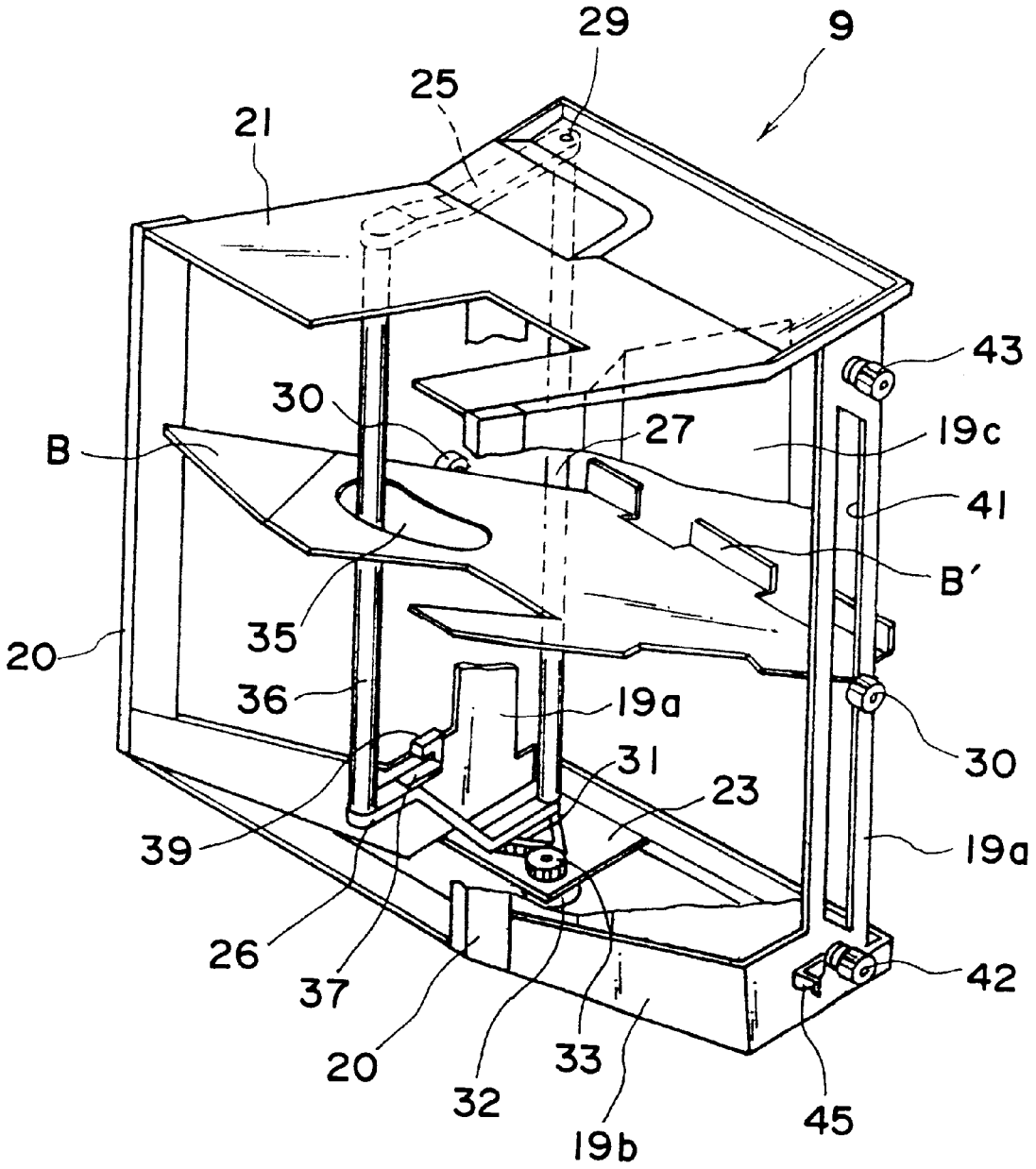
FIG. 4 is an oblique view of the bin unit of the same apparatus.

Referring to FIG. 4, on the far rear side of the base portion of the bin frame 19, a supporting plate 23 is affixed, and on this supporting plate 23, a rotational axis 27 which is fixed to a top arm 25 at the top end, and to a bottom arm 26 at the bottom end, is rotatively supported, with one end being supported by a pivot (unillustrated) provided on the supporting plate 23 and the other end being supported by a pivot 29 provided on the bin cover 21. Further, a segment gear 31 is disposed on the supporting plate 23, in such a manner that it can rotate about a rotational axis erected on the supporting plate 23, and the aforementioned bottom arm 26 is fixed to this segment gear 21. Below the supporting plate 23, a pulse motor 32 is disposed, and a gear 33 fixed to the output shaft of this pulse motor 32 is engaged with the segment gear 31. Across the end portions of the bottom and top arms 26 and 25, a jogging rod 35 is attached, wherein this jogging rod 35 is put through all of the bins B, through a hole 35 provided on each of the bins B, and is oscillated by the rotation of the segment gear 31. Further, the bottom arm 26 is provided with a light shielding plate 37, and as the light shielding plate 37 integrally rotates with the bottom arm 26, it turns on or off a retract location sensor 39 disposed on the rear side.

At the base portion of the bin B, a trunnion 30 is rotatively mounted, wherein the bins B are stacked in the bin unit 9 in such a manner that the trunnions 30 project through a slit 41 provided on the vertical portions 19*a* of the bin frame 19 and are fitted in the guide rail 7, being stacked on top of each other (FIG. 3). The bottom-most trunnion 30 is in contact with the bottom guide roller 42 supported rotatively by the vertical portion 19*a* of the bin frame 19, and the top-most trunnion 30 is in contact with the top guide roller 43 supported rotatively by the vertical portion 19*a* of the bin frame 19. Therefore, the bins B stacked in the bin unit 9 hold intervals equal to the diameter of the trunnion 30.

The top and bottom guide rollers 43 and 42 of the bin unit 9 are fitted in the guide rail 7, whereby the bin unit 9 is enabled to move vertically.

On the front and rear side plate 3 and 4, a cam shaft holder 47 (FIG. 2) is mounted at the location correspondent to the location of the bottom pair of the discharging roller 15, as shown in FIGS. 2 and 3. Between this cam shaft holder 47 and the aforementioned base 5, a lead cam shaft 50 is rotatively mounted with the provision of a bearing 49 which bears the thrust load. At the top end of the lead cam shaft 50, a lead cam 40 provided with a helical cam surface is fixedly mounted, and at the bottom end, a sprocket 51 is fixedly mounted. Between this sprocket 51 and a shifting motor 52, a chain 53 is stretched, whereby the lead cam 40 is selectively rotated forward or backward by the shifting motor 52 capable of rotating forward or in reverse.

Figure 5:
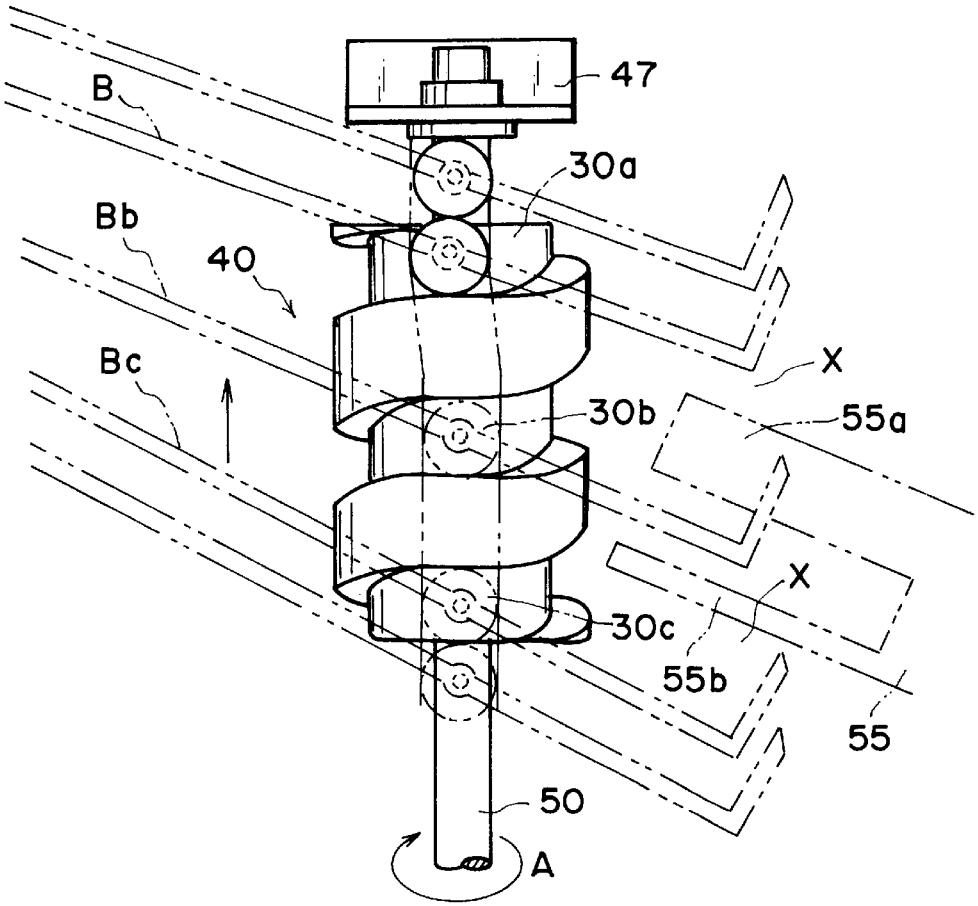
FIG. 5 is an enlarged side view of a portion of the same apparatus, depicting how the bin interval is widened by a lead cam.
Figure 6:
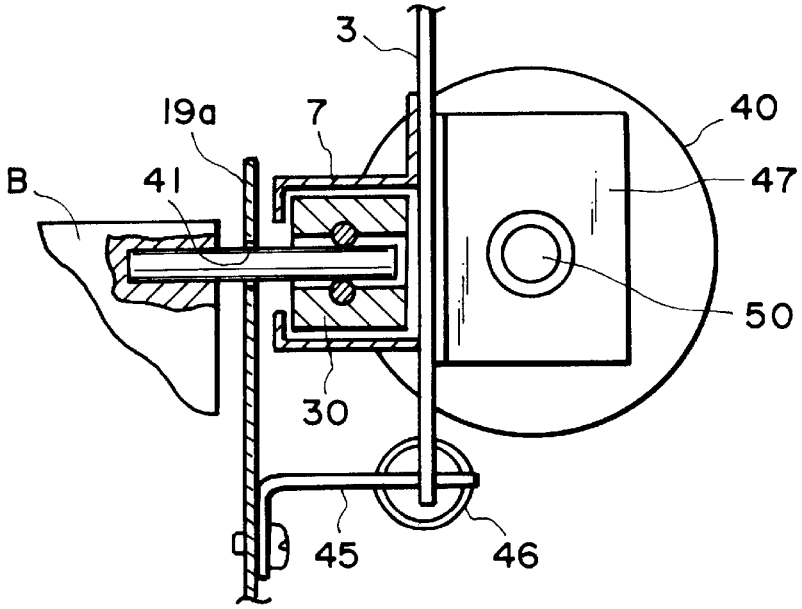
FIG. 6 presents cross-sections of a trunnion mounted on the bin and the lead cam for driving the trunnion, in the same apparatus.

The lead cam 40 is disposed so as to face the bottom pair of discharging rollers 15 disposed at the substantial center portion of the sorter main assembly 6. It catches, with its helical cam surface, the trunnion 30 of the bin B which is on its way to the location where it comes to face the bottom pair of the discharging rollers 15, and vertically moves the trunnion 30 along the guide rail 7 (FIGS. 5 and 6). Referring to FIG. 5, the trunnion 30*c* is moved to the center portion of the lead cam 40 as the lead cam 40 rotates once in the direction of an arrow A (location 30*b* in the drawing), and is moved to the edge of the lead cam 40 (location 30*a* in the drawing) as the lead cam 40 rotates once more. Meanwhile, two intervals X and X which are wider than the normal bin interval are formed between the bin Bb and the bin Ba which is above the bin Bb, and between the bin Bb and the bin Bc which is below the bin Bb, wherein the bin Bb is at the location where it is facing the bottom pair of the discharging rollers 15, and receives the sheet from the bottom pair of the discharging rollers 15.

On the other hand, on the front side bin frame 19 of the bin unit 9, a sheet jogging reference portion 19*c* is provided, against which the sheets S stored in the bin B are jogged to be aligned. Also, on the sorter main assembly 6, an electric stapler 70 for stapling the sheets stored in the bin Bb is disposed so as to face the bin which faces the bottom pair of the discharging rollers 15.

Figure 7:
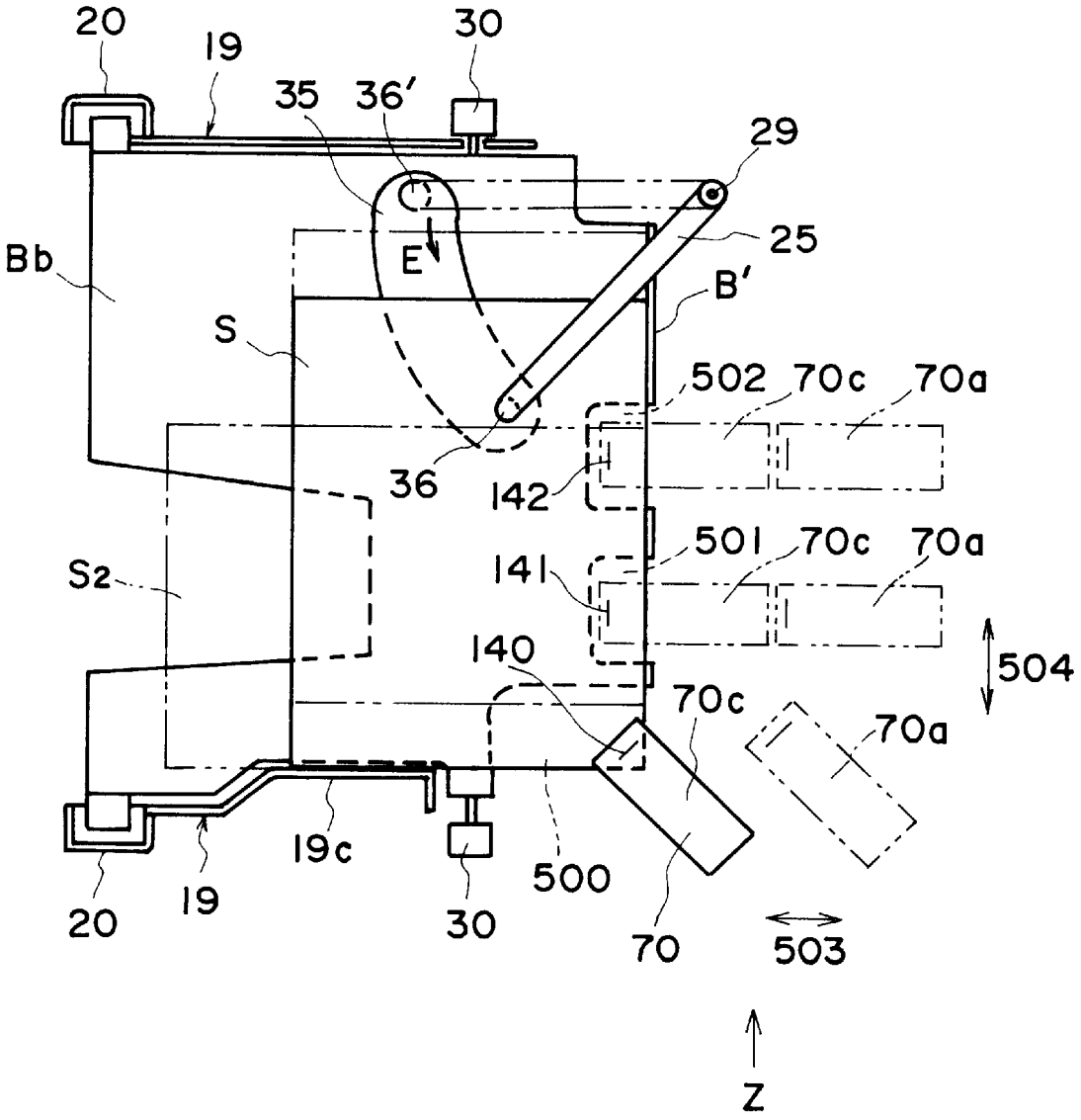
FIG. 7 is a plan view of the bin portion of the sheet post-processing apparatus in the same apparatus.

The electric stapler 70 is moved by a stapler moving mechanism, which will be described later, so that the discharged sheets can be bound at a single front point (with a stapler at a point 140), at two points (with staplers at points 141 and 142), or at a single rear point (with a stapler at the point 142) when the sheets are discharged in such a manner as illustrated by the sheet S2 in FIG. 7.

It should be noted here that the bin B is provided with cutaways 500, 501, and 502 which respectively correspond to the stapling locations, so that the bin B does not interfere with the stapler 70.

The stapler 70 is movable in the directions indicated by arrow marks 504 and 503, wherein, after being moved in the arrow 504 direction to the respective locations, it is moved from a location 70*a* to a location 70*c* to staple the sheets.

Figure 8:
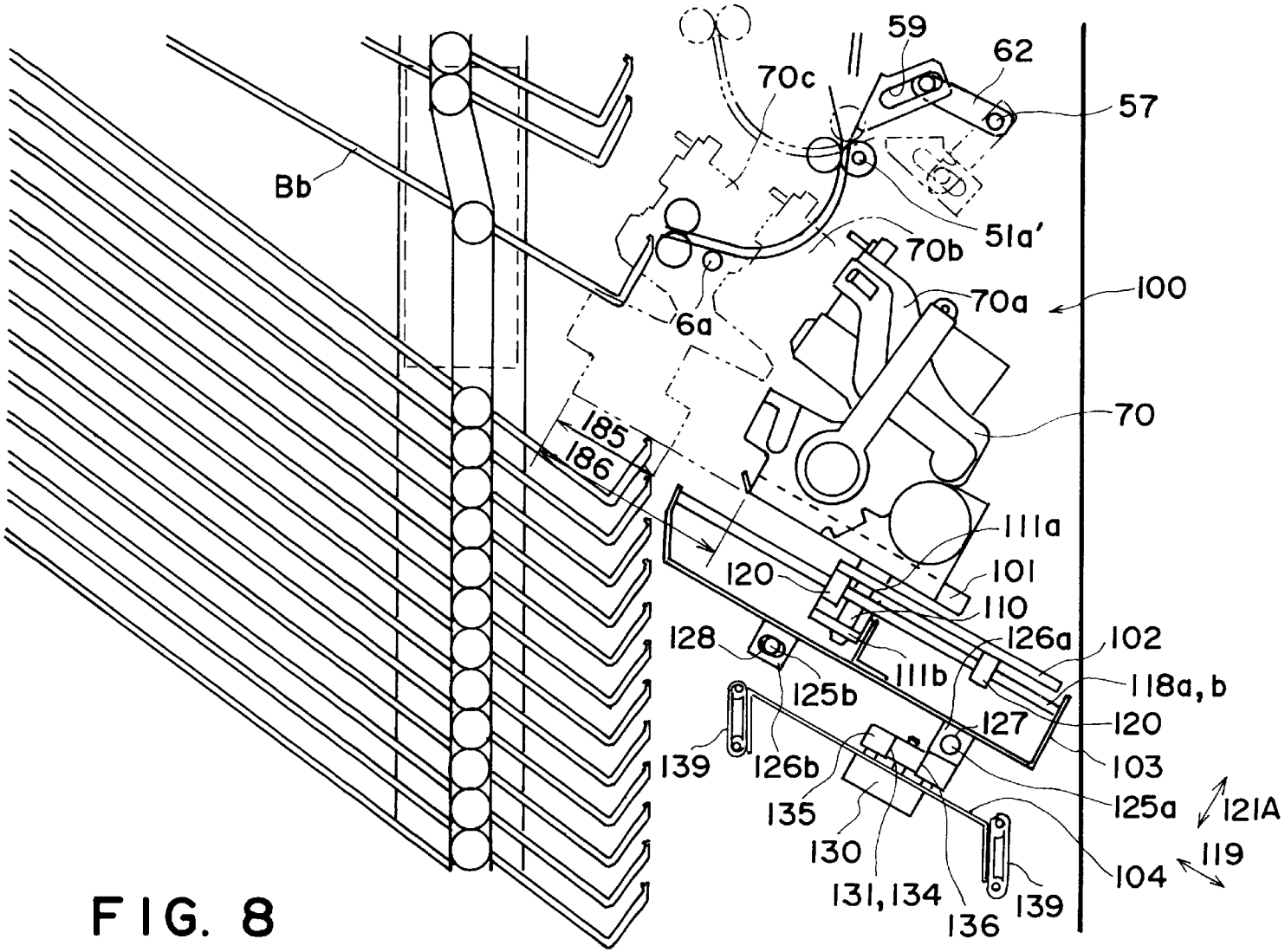
FIG. 8 is a longitudinal section of the stapler portion of the same apparatus.
Figure 9:
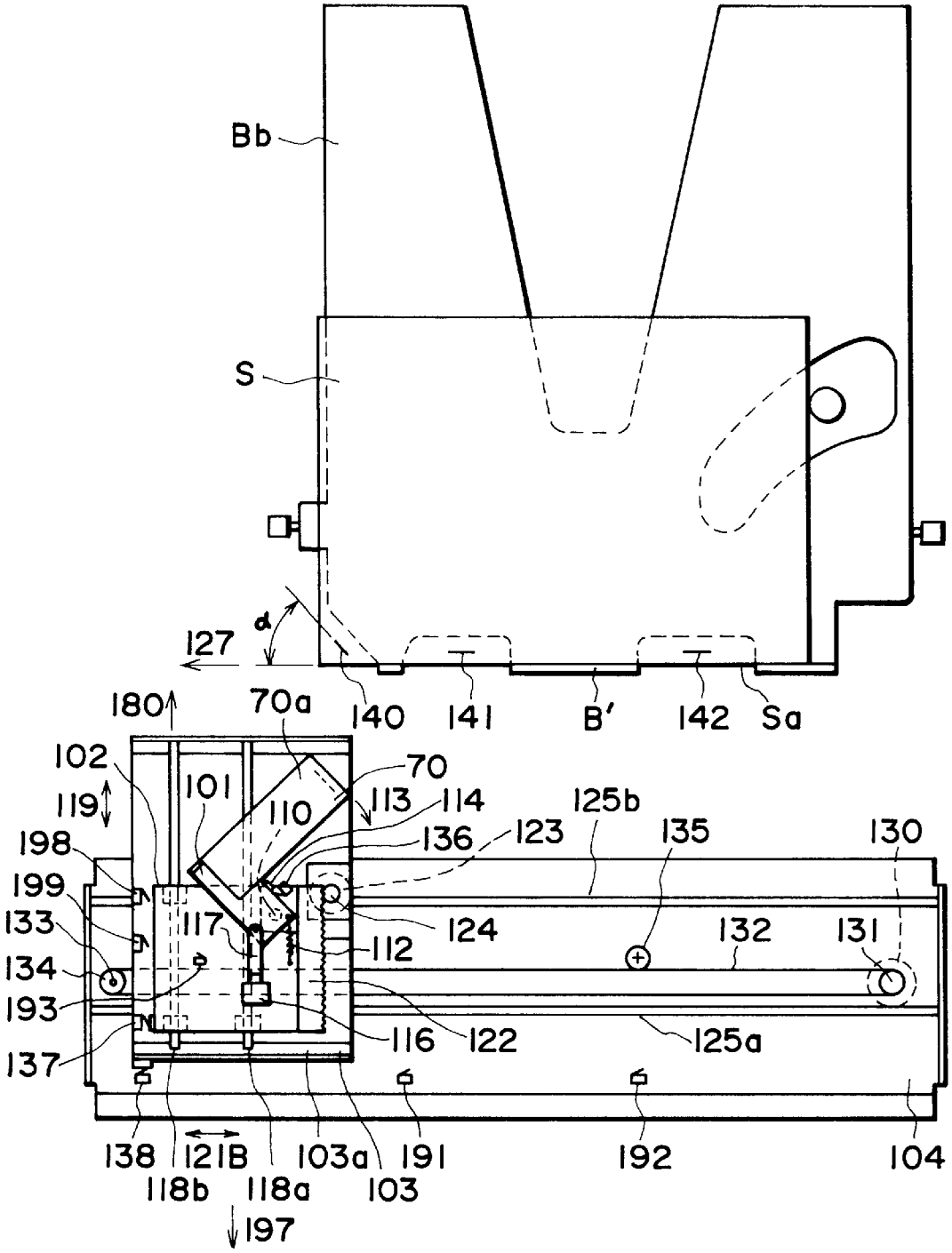
FIG. 9 is a plan view of the bin and stapler portions, depicting the stapling operation.

Next, a description will be given as to the stapling apparatus 100 (FIGS. 8 and 9). As for the orientation of the stapler 70 shown in FIGS. 3 and 8, it corresponds to the staples placed at the points 141 and 142.

The stapler 70 is fixedly mounted on a first supporting member 101, and on the first supporting member 101, a supporting axis 110 is fixedly mounted.

The supporting axis 110 of the first supporting member 101 is rotatively supported by a second supporting member 102, being put through the hole of two supporting portions 111*a* and 111*b* of the second supporting member 102.

A spring 112 is attached to one side of the first supporting member 101 by one end, and the other end of the spring 112 is fixed to the second supporting member 102, whereby the first supporting member 101 is rotatively spring-loaded in the direction indicated by an arrow mark 113 about the supporting axis 110, being held at a stopper 114.

To the other side of the first supporting member 101, that is, the side opposite to where the spring 112 and supporting axis are, one end of a link 117 is connected, and the other end of the link 117 is connected to a solenoid 116 fixed on the second supporting member 102.

Further, the second supporting member 102 is provided with guide members 120, on the bottom portion. Each of the guide members 120 is engaged with one of two rails 118*a* and 118*b* provided on a third supporting member 103, enabling thereby the second supporting member 102 to advance or retreat in the direction indicated by an arrow mark 119.

The engagement holes of the guide member 120 are given a shape different from each other, one hole (or rail 118*a* or 118*b*) being circular and other being oval, so as to eliminate the unwanted movement (play) of the second supporting member 102, including the stapler 70, in the directions indicated by arrow marks 121A and 121B.

Further, the second supporting member is provided with a rack gear 122, which is engaged with a gear 124 of a motor 123 fixedly mounted on the third supporting member 103.

As this motor 123 rotates, the second supporting member moves in the direction of an arrow mark 119, being guided by the rails 118*a* and 118*b*.

Further, the third supporting member 103 is provided with a guide members 126*a* and 126*b*, on the bottom portion. They are engaged with two rails 125*a* and 125*b* of a fourth supporting member 104, respectively, enabling thereby the third supporting member 103 to move in the direction of an arrow mark 127. The hole of the guide member 126*a* and hole of the guide member 126*b* which engage with the rails 125*a* and 125*b*, respectively, are given a shape different from each other, one being round and the other being oval, eliminating thereby the unwanted movement (play) of the third supporting member in the direction indicated by arrow marks 121A and 119.

Further, on the fourth supporting member 104, a motor 130 and an idler pulley 134 are fixedly mounted, the idler pulley 134 being rotatively mounted on an axis 133, wherein the motor 130 drives a pulley belt 131 and a belt 132 is stretched around two pulleys 131 and 134. This belt 132 is fixed to a portion 136 of the third supporting member 103. A reference numeral 135 designates a belt tensioner. As the motor 130 rotates, the driving force is transmitted through this belt 132, whereby the third supporting member 103 is moved in the direction of an arrow 121B, being guided by the rails 125*a* and 125*b*.

In order to detect the stand-by locations of the first, second, and third supporting members, detecting means 136, 137, and 138, such as microswitches, are provided (FIG. 9).

The fourth supporting member 104 is supported by a guide rail 139 or the like (accuride rail), and can be removed from the main assembly during the maintenance though it is normally fixedly positioned on the sorter main assembly by an unillustrated locking means.

The stapling apparatus 100 is constituted of the components described hereinbefore. The image forming apparatus 200 and sorter 1 are provided with controlling apparatuses (CPU) 200A and (CPU) 1A, respectively, which control various operations and the communications between the two.

This embodiment is structured as described hereinbefore, wherein the sheet S discharged from an image forming apparatus such as a copying machine is guided into the first sheet conveying path 11 or second sheet conveying path 12, by the deflector 17 which changes its orientation in response to the sorting mode selection, that is, depending on which sorting mode is selected, non-sort mode (sheets are not sorted) or sort mode (sheets are sorted).

Next, a binding operation involving two or more bins B will be described.

When carrying out the binding operation involving two or more bins B (S113), it is most efficient to start from the last bin B in which the sheets have been discharged and stored.

<Single Point Binding Mode>

Figure 10:
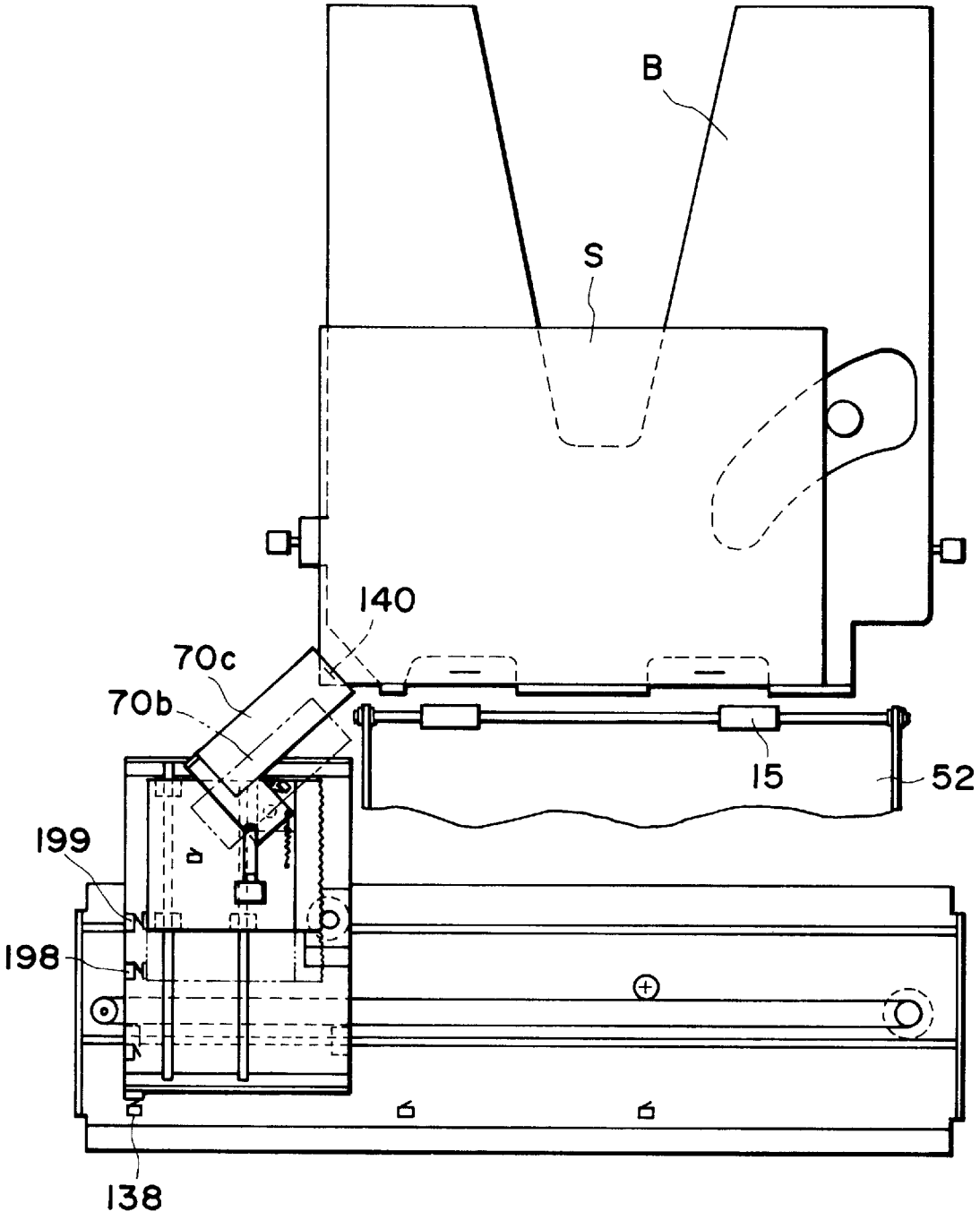
FIG. 10 is a plan view of the bin and stapler portions, depicting the stapling operation.

First, as described hereinbefore, the second supporting member 102 is moved together with the stapler mounted on the first supporting member 101, and the stapler 70 is moved from the location 70*a* to the location 70*c*, where the sheets in the first bin are bound. Then, the motor 123 is rotated in the counterclockwise direction (S117) to return the stapler, wherein at this time, the stapler is not returned as far as the location 70*a*, being instead moved to the location 70*b* (midway stand-by location), and the motor 123 is stopped (S119). This location is detected by the detecting means 199 (S118) (FIGS. 3 and 10).

Next, in response to a bin shift completion signal (S12), the stapler 70 is moved by the same driving means as described before, from the location 70*b* to the location 70*c* where the sheets in the second bin are bound. Then, the stapler 70 is again returned to the midway stand-by location 70*b*. Next, the bins B are shifted in response to a signal indicating the completion of a single cycle of the stapler operation. The preceding steps are automatically repeated till all the sheets in all the bins B are bound. After the sheets in the last bin are bound, the second supporting member 102 is returned together with the stapler 70 mounted on the first supporting member 101, and then, the stapler 70 is returned from the location 70*c* to the aforementioned stand-by location 70*a* (FIG. 9).

It is needless to say that the number of times the bins are shifted during the automatic binding operation is the same as that during the sorting operation.

The stapler moving distance 185 from the stapling location 70*c* to the midway stand-by location 70*b* is shorter than the distance 186 between the locations 70*c* and 70*a* (FIG. 8). This is because the distance (185) which the stapler 70 retreats during the continuous stapling operation is set up to be a minimum distance which the stapler 70 must move in order not to interfere with the bins during the bin shifting operation; therefore, the time for reciprocating the stapler 70 is reduced, realizing thereby a reduction in the overall stapling time.

<Two Points Binding Mode>

Figure 11:
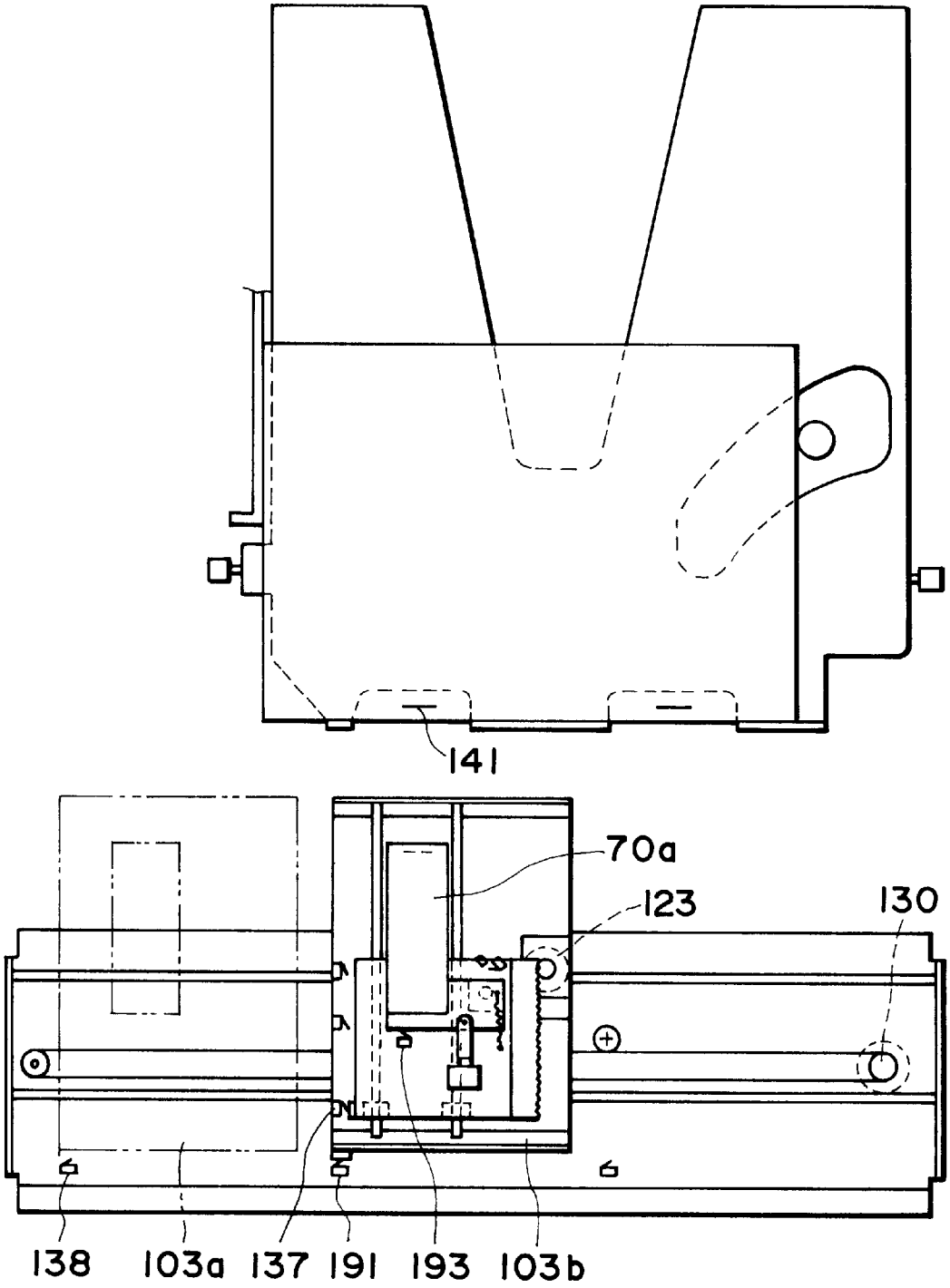
FIG. 11 is a plan view of the bin and stapler portions, depicting the stapling operation.
Figure 23:
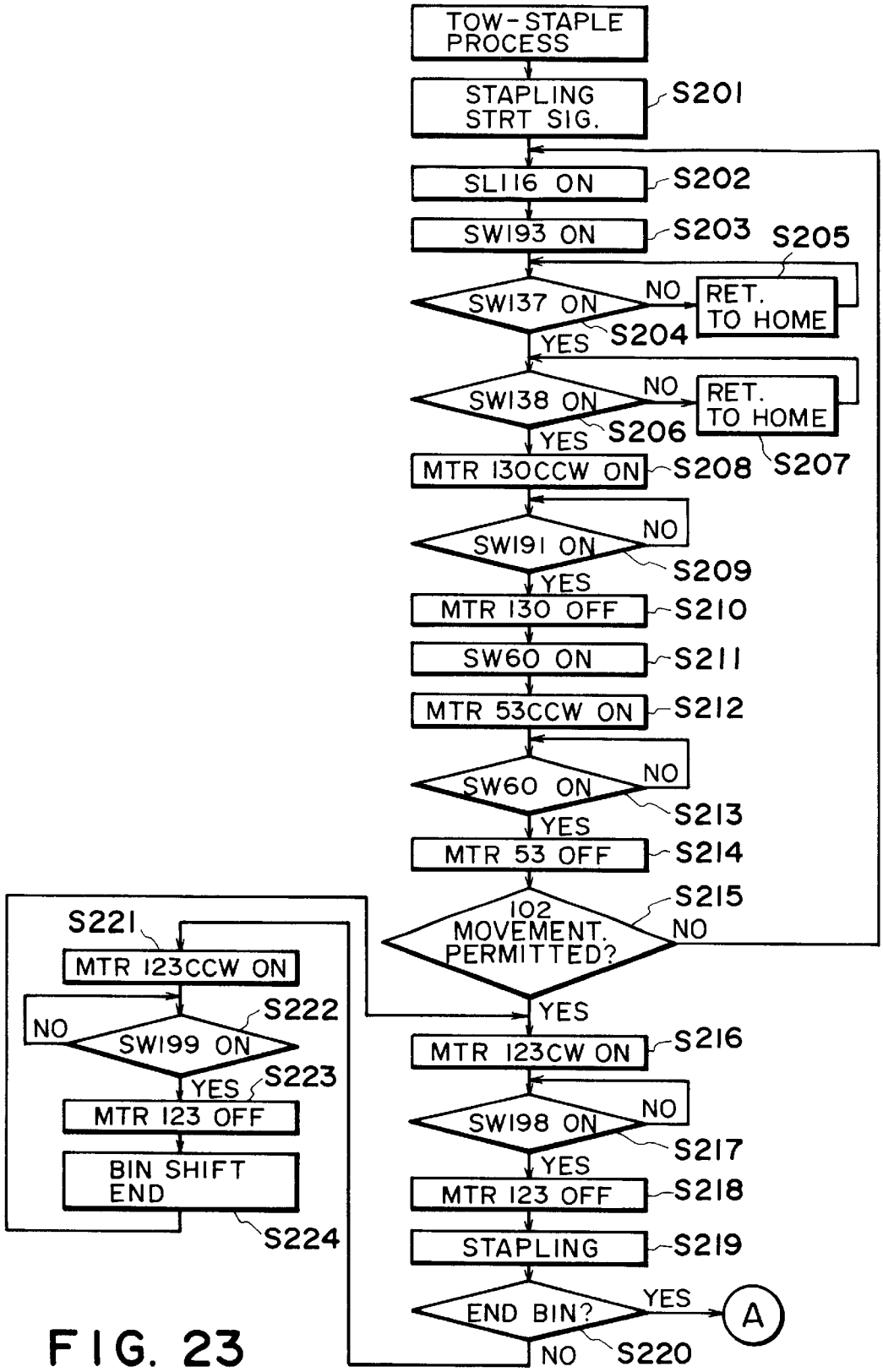
FIG. 23 is also a flow chart for the stapling operation of the sheet post-processing apparatus according to the present invention.
Figure 24:
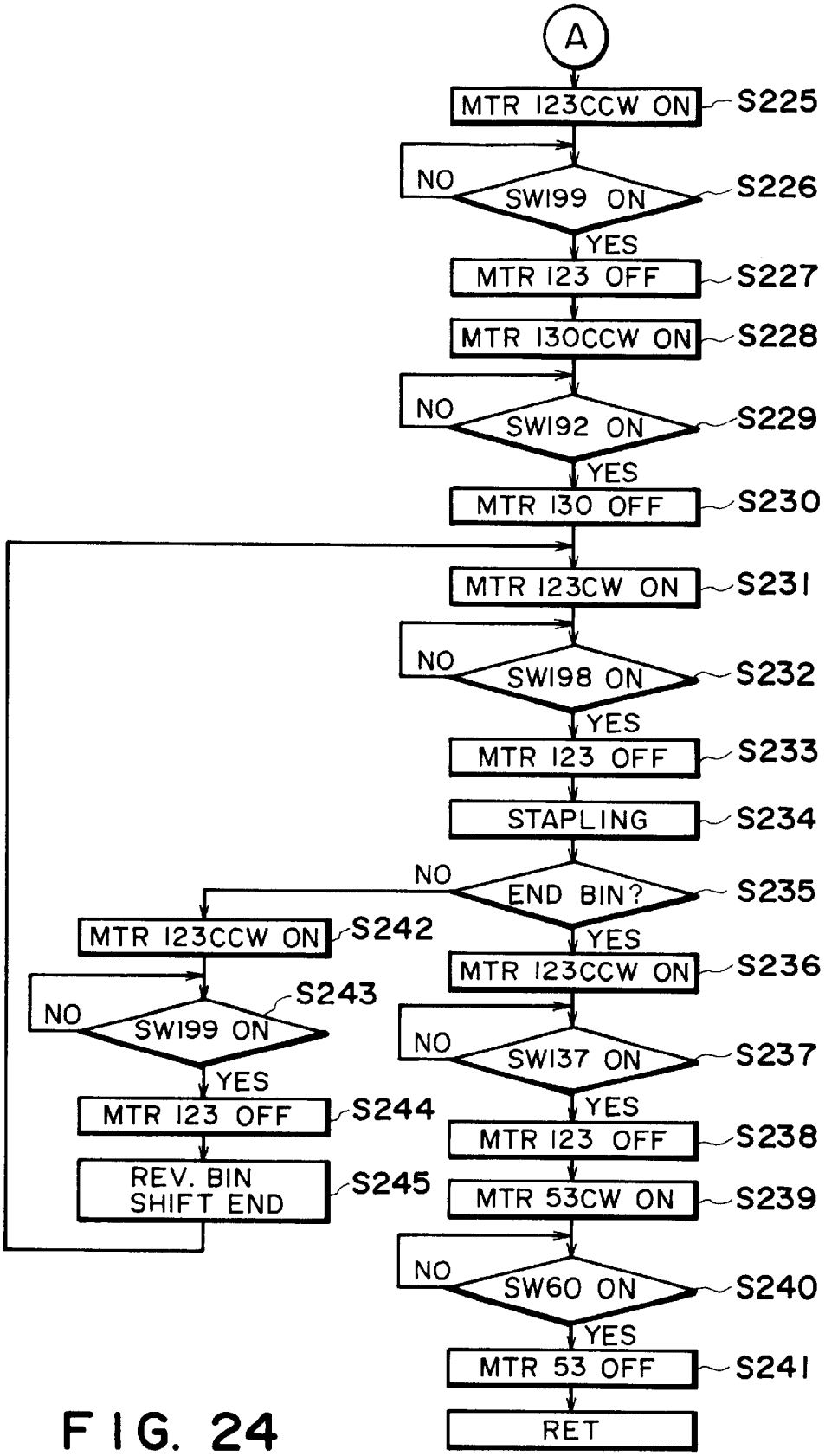
FIG. 24 is a flow chart for the stapling operation of the sheet post-processing apparatus according the present invention, which continues from FIG. 23.
Figure 25:
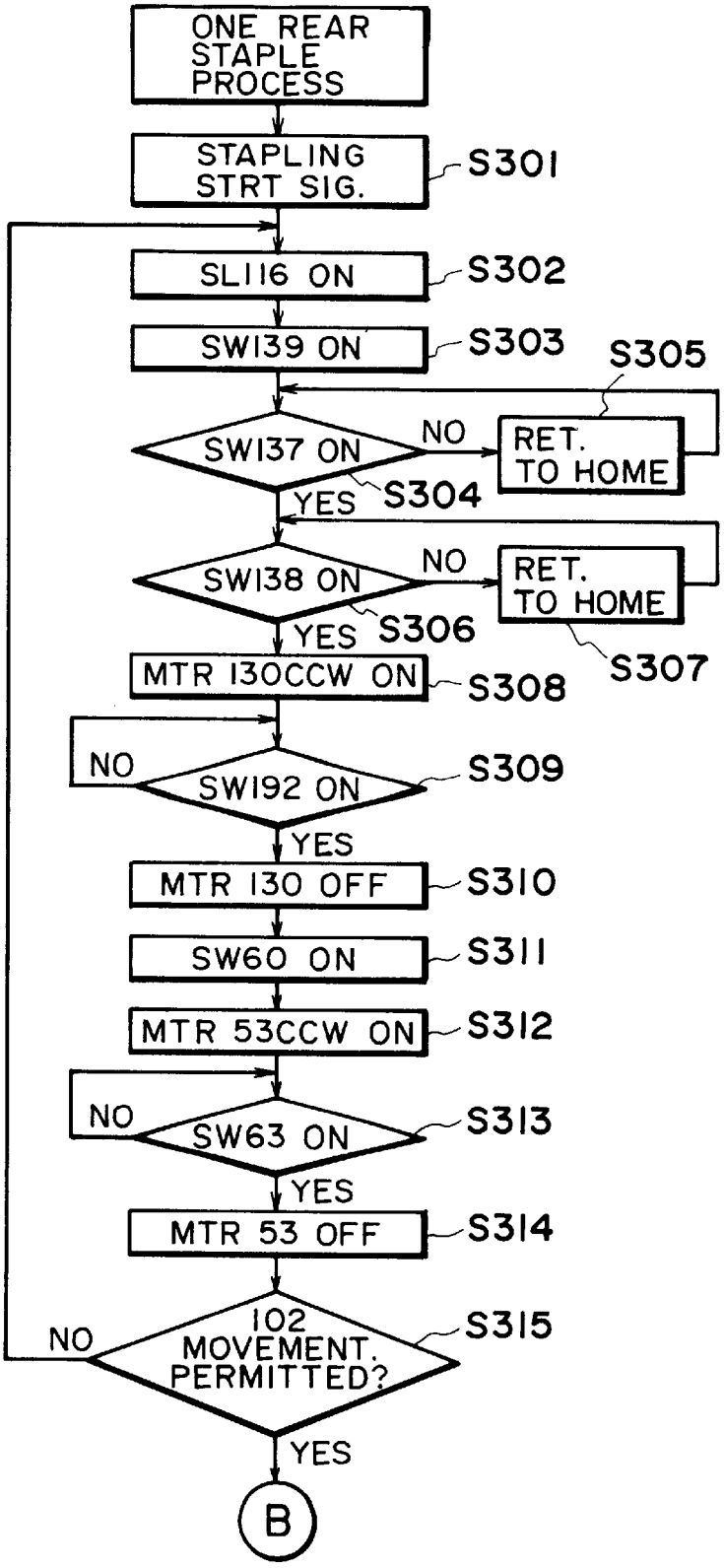
FIG. 25 is also a flow chart for the stapling operation of the sheet post-processing apparatus according the present invention.
Figure 26:
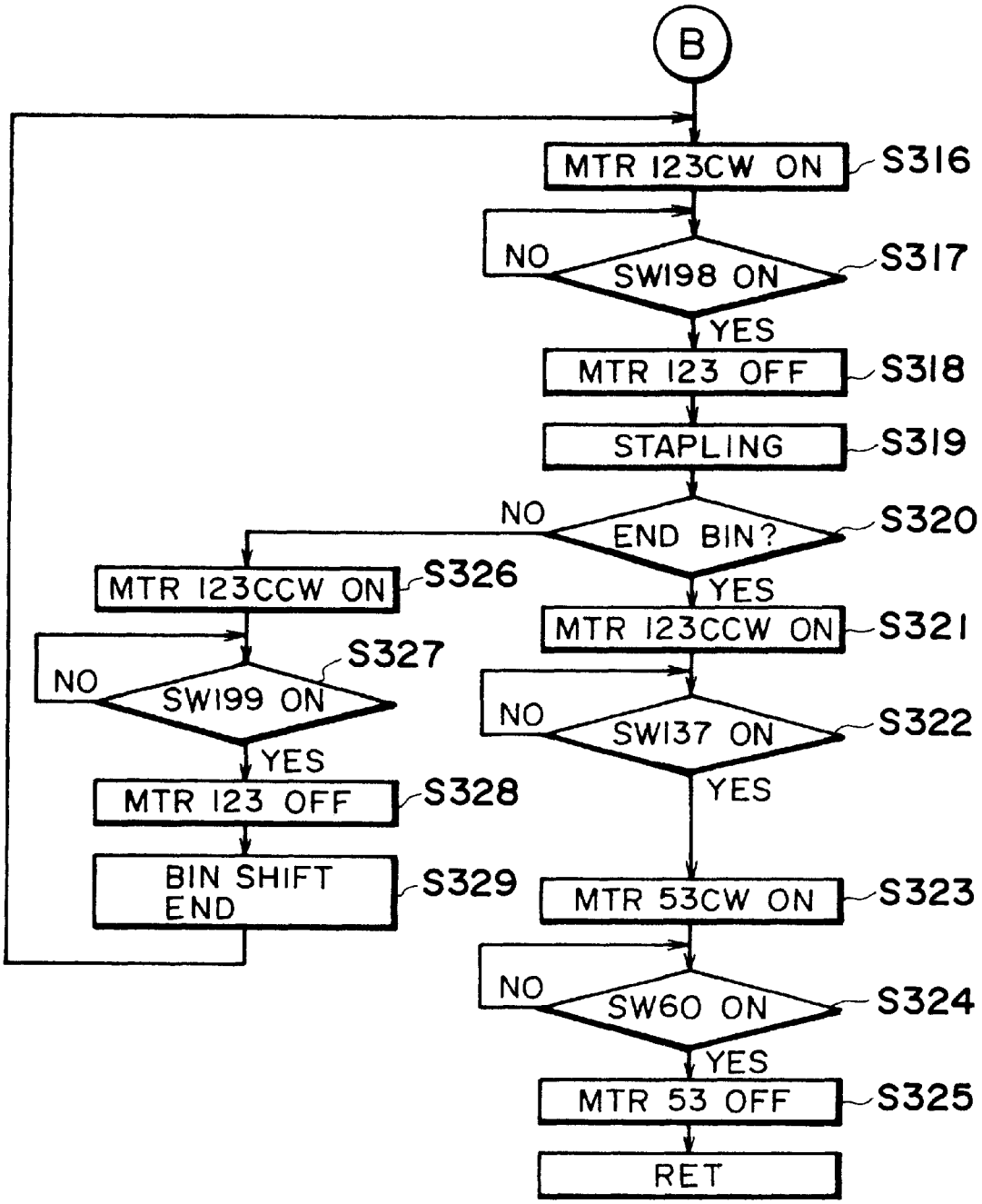
FIG. 26 is a flow chart for the stapling operation of the sheet post-processing apparatus according the present invention, which continues from FIG. 25.
Figure 27:
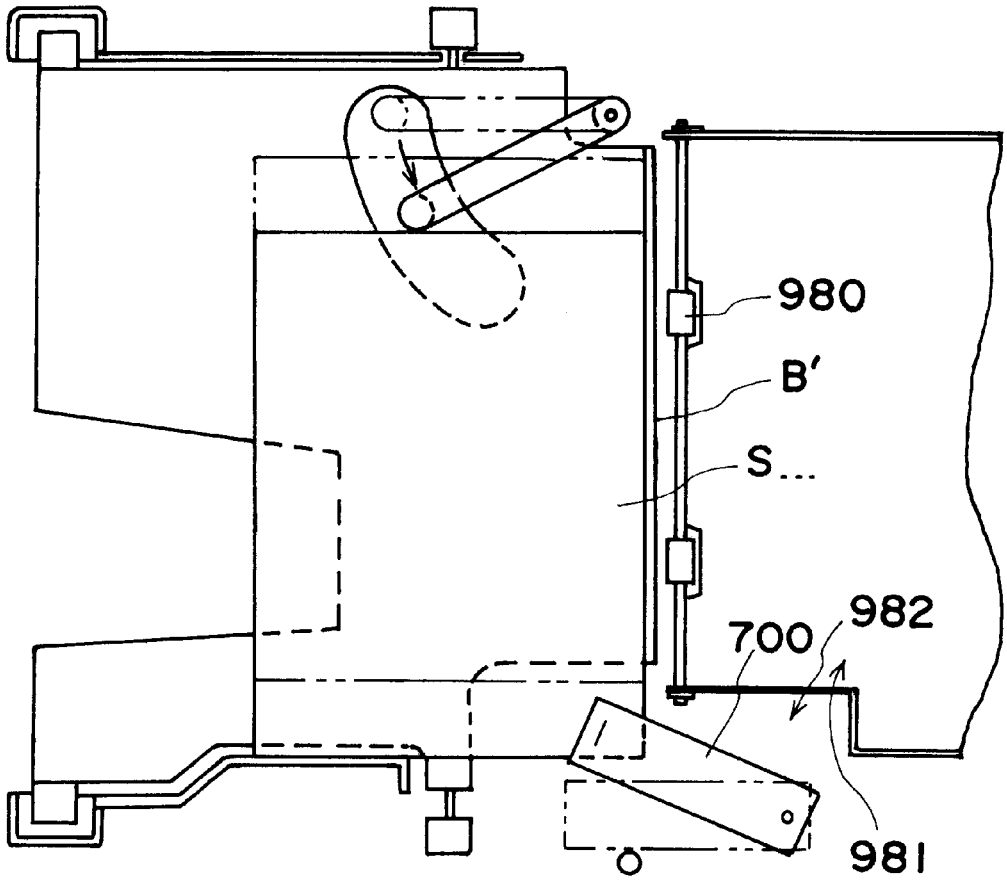
FIG. 27 PRIOR ART
FIG. 27 is a plan view of a sheet post-processing apparatus according to a related art, and its stapler portion.
Figure 28:
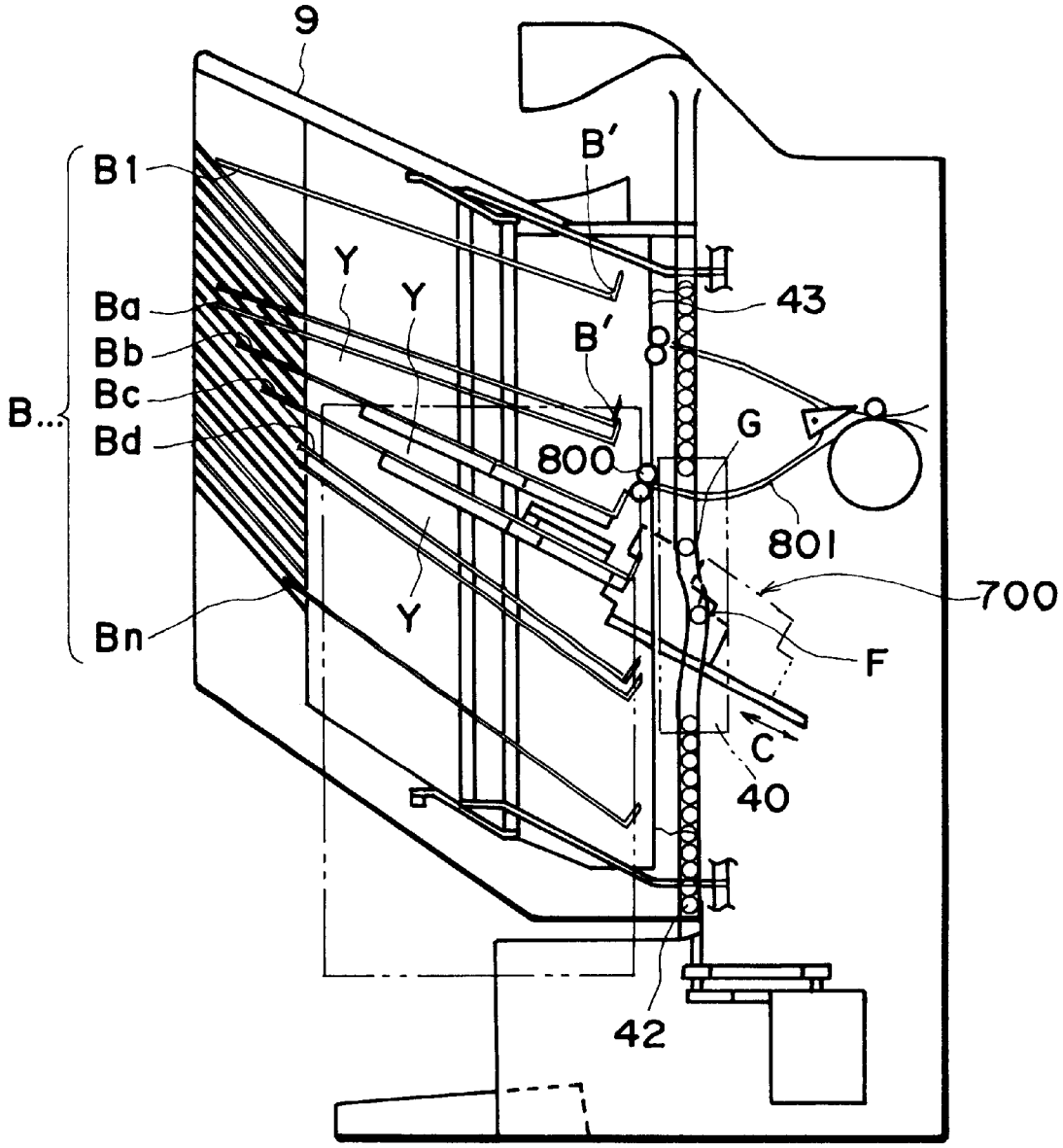
FIG. 28 PRIOR ART
FIG. 28 is a longitudinal section of a sheet post-processing apparatus.
Figure 29:
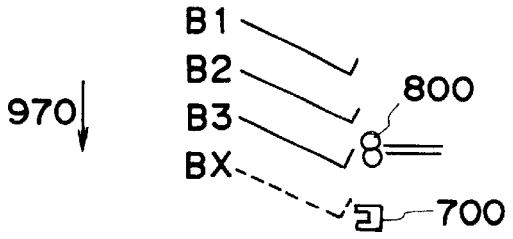
FIG. 29 PRIOR ART
FIG. 29 is a schematic drawing depicting the operational concept of the sheet post-processing apparatus.
Figure 30:
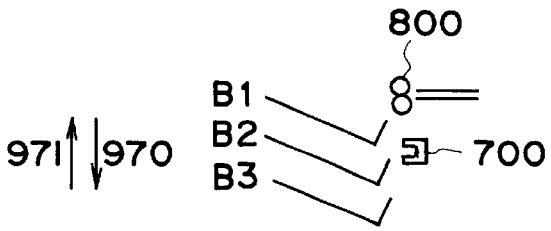
FIG. 30 PRIOR ART
FIG. 30 is a schematic drawing depicting the operational concept of the sheet post-processing apparatus.
Figure 31:
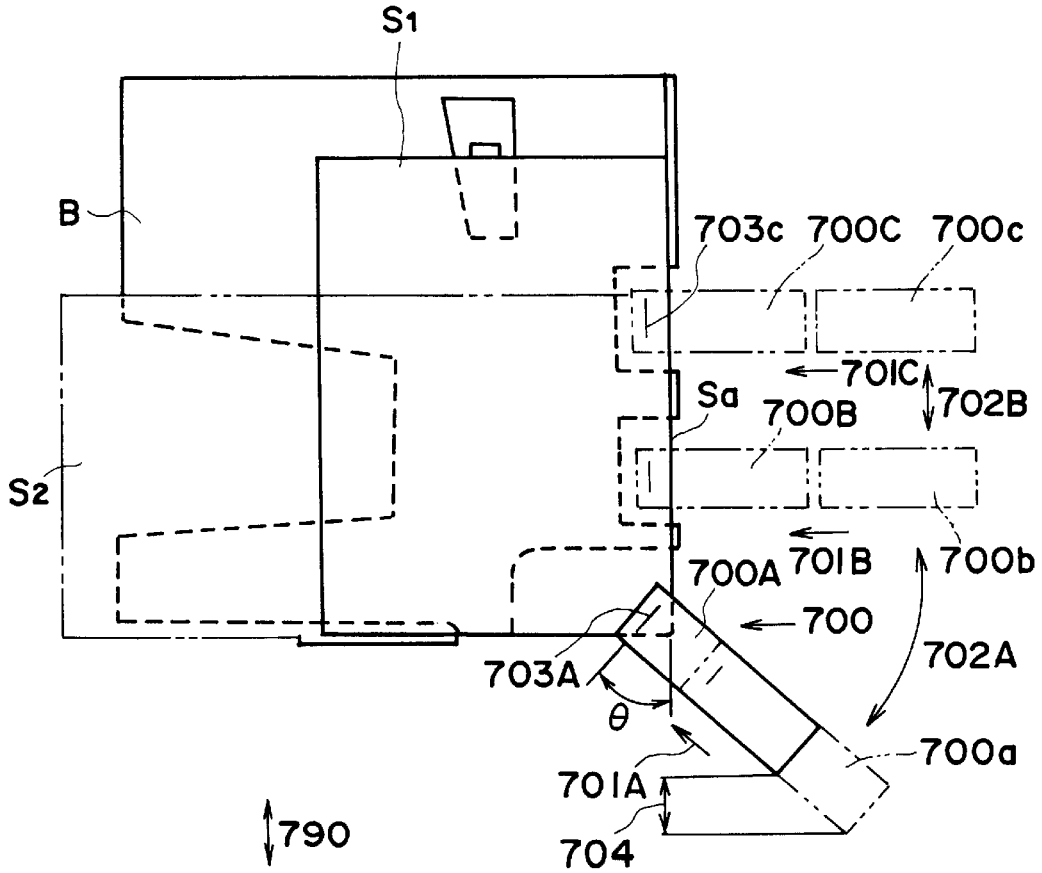
FIG. 31 PRIOR ART
FIG. 31 is a plan view of a sheet post-processing apparatus.
Figure 32:
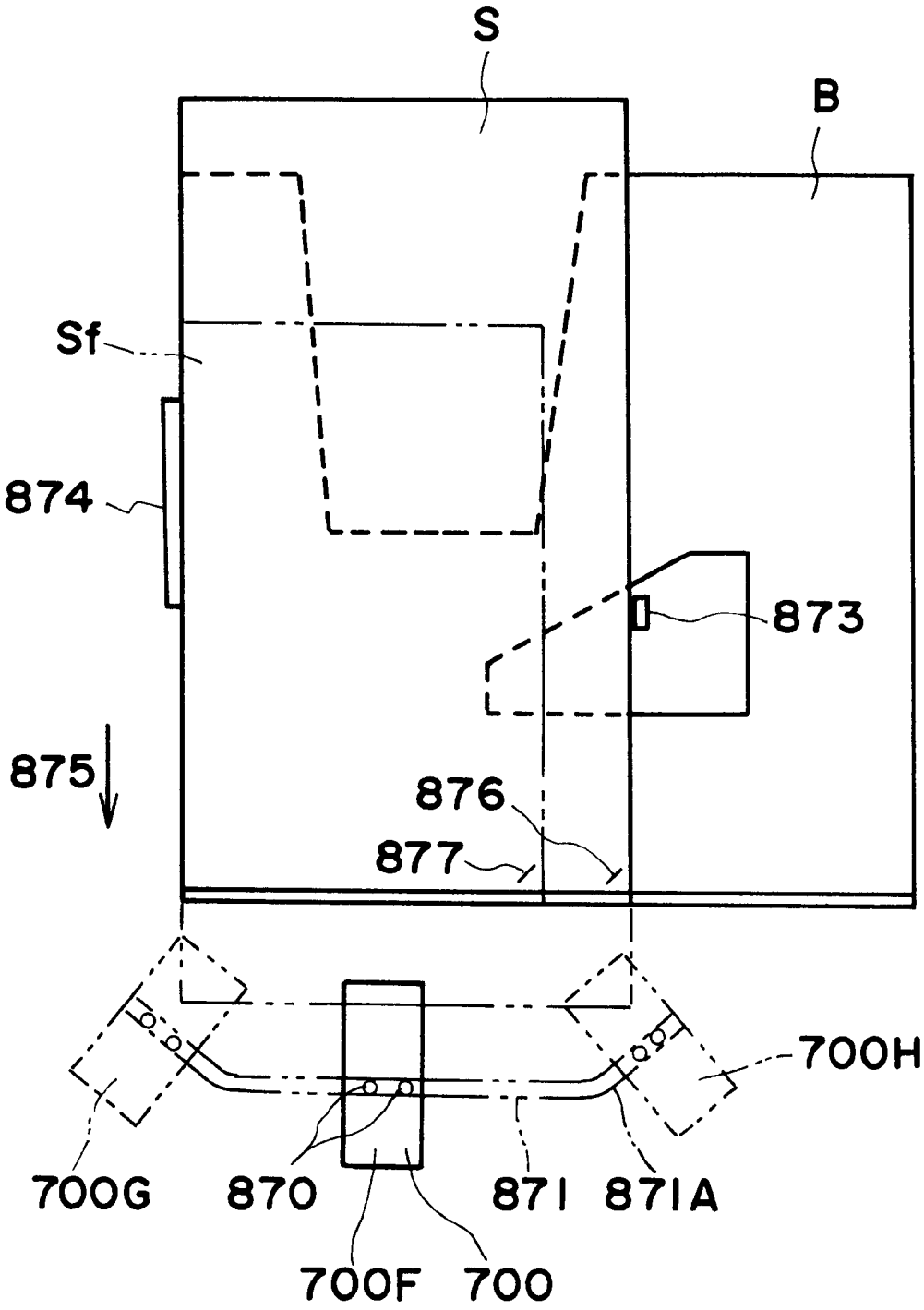
FIG. 32 PRIOR ART
FIG. 32 is a plan view of a sheet post-processing apparatus.

Referring to FIGS. 23 and 24, as a two point sheet binding mode start signal is sent in from the controlling means (S201), the solenoid 116 is activated (S202), whereby the first supporting member 101 carrying the stapler 700 is rotated counterclockwise about the rotational axis 110 and is fixedly positioned (as illustrated by the double-dot chain line in FIG. 11).

After the completion of its rotation, its location is detected by the detecting means 193 (S203). At this time, it is detected by the detecting means 137 and 138 whether or not the second and third supporting members 102 and 103 are at their stand-by positions, respectively, (S204, S206) and when not, they are returned to their stand-by locations (S205, S207).

At substantially the same time as the preceding step, the motor 130 is rotated counterclockwise (S208) to move rightward the third supporting member 103 from the location 103*a* to the location 103*b*, and then, the motor 130 is stopped (S210).

The arrival of the third supporting member 103 at the location 103*b* is detected by the detecting means 191 (FIG. 11) (S209).

As for the motor 130, a DC motor or the like may be employed, and its rotation may be stopped by the detecting means 191. Also, a stepping motor or the like may be employed, wherein the motor 130 is stopped after the third supporting member 103 is moved a predetermined distance from the aforementioned stand-by location, that is, the location of detecting means 138; in this case, the detecting means 191 serves to confirm the accuracy in the positioning of the third supporting member 103.

At substantially the same time, the location of the path end portion 52 is detected by the detecting means 60 (S211), and the path moving motor 53 is counterclockwise rotated (S212) to rotate the lever 62, whereby the path end portion 52 is moved from the location 52*a* to the location 52*b*.

When it is detected by the detecting means 163 (FIG. 3) that the path end portion 52 has reached the location 52*b* (S213), the motor 53 is stopped (S214), and the path end portion 52 is held at this location.

Figure 12:
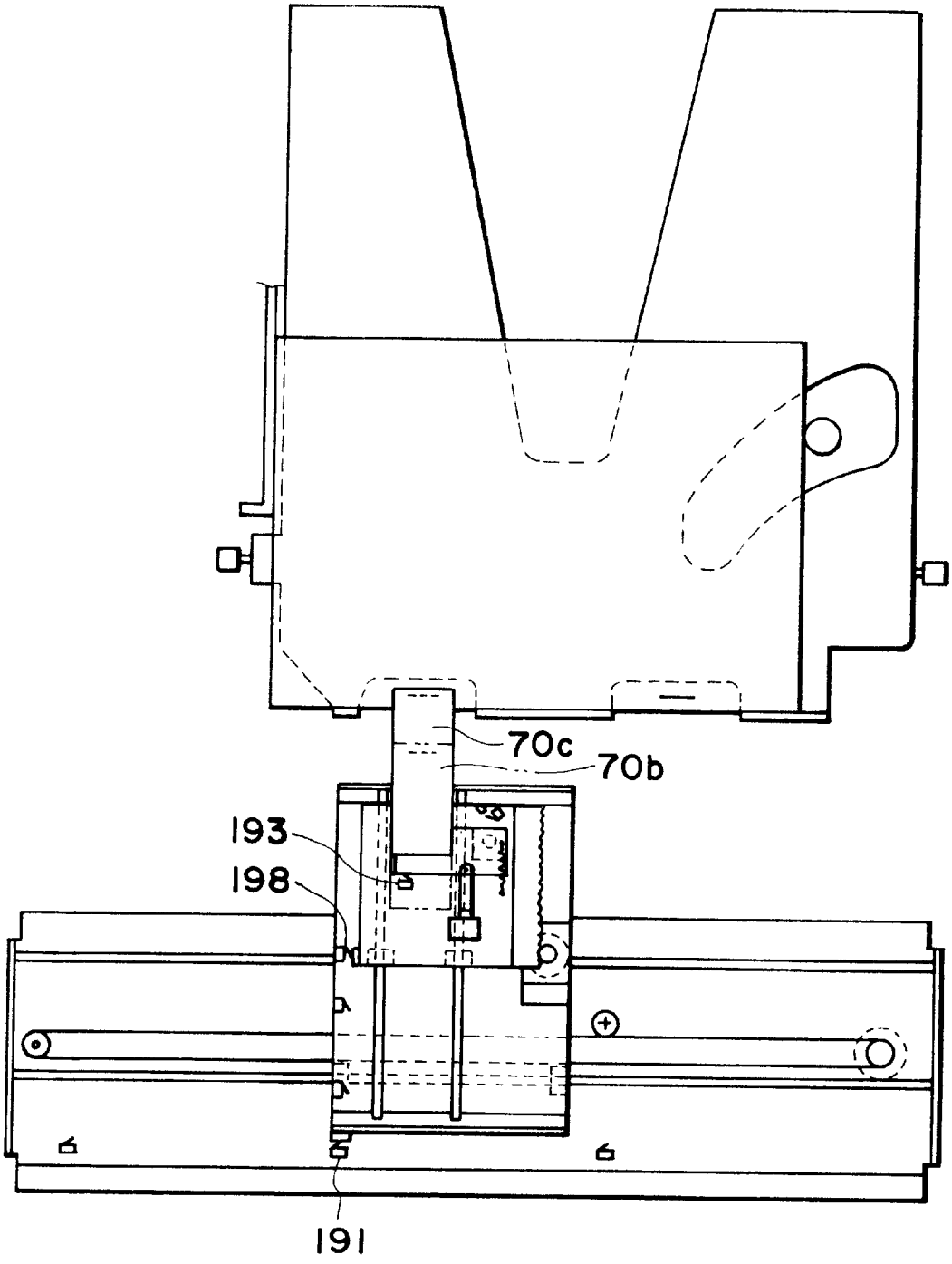
FIG. 12 is a plan view of the bin and stapler portions, depicting the stapling operation.

As soon as each of the detecting means 191, 193, 163, and 137 sends to the controlling means, a signal indicating that the relevant supporting means has reached the predetermined location, a signal is sent out from the controlling means to allow the second supporting means to move to the stapling position in the same manner as in the case of the aforementioned single point binding mode (S215), whereby the motor 123 is clockwise rotated (S216) to move the stapler 70 from the location 70*a* to the location 70*c*. Then, after it is detected by the detecting means 198 that the stapler has reached the location 70*c* (S217), the motor 123 is stopped (S218), and a staple is struck into the sheets S, at a point H (S219) (FIG. 12).

Here, when the detecting means 163 fails to detects that the path end portion 52 has reached the position 52*b*, the movement of the second supporting means is prohibited.

The location 52*b* where the path end portion 52 is retracted is set up at the location where it does not interfere with the stapler 70 when the stapler 70 is moving to the location 70*c* during the preceding operation. Further, the stapler 70 is caused to operate after its location is confirmed through the detecting means 163, 191, 193, and 137 (in particular, 163); therefore, the stapler 70 does not interfere with the bins and path end portion 52. As for the movements of the path end portion 52, first supporting member 101, and third supporting member 103, they may be moved in any order or at the same time as long as they are moved while the presence of the second supporting means 102 is detected by the detecting means 137 and the stapler 70 is at the location 70*a*.

Thus, the binding by the stapler 70 ends.

In the case of a single bin operation (S220), the motor 123 is rotated counterclockwise (S225) to return the stapler 70 to the midway stand-by location 70*b* because of the same reason as described before, and is stopped after the presence of the stapler 70 at the location 70*b* is detected by the detecting means 199.

Figure 13:
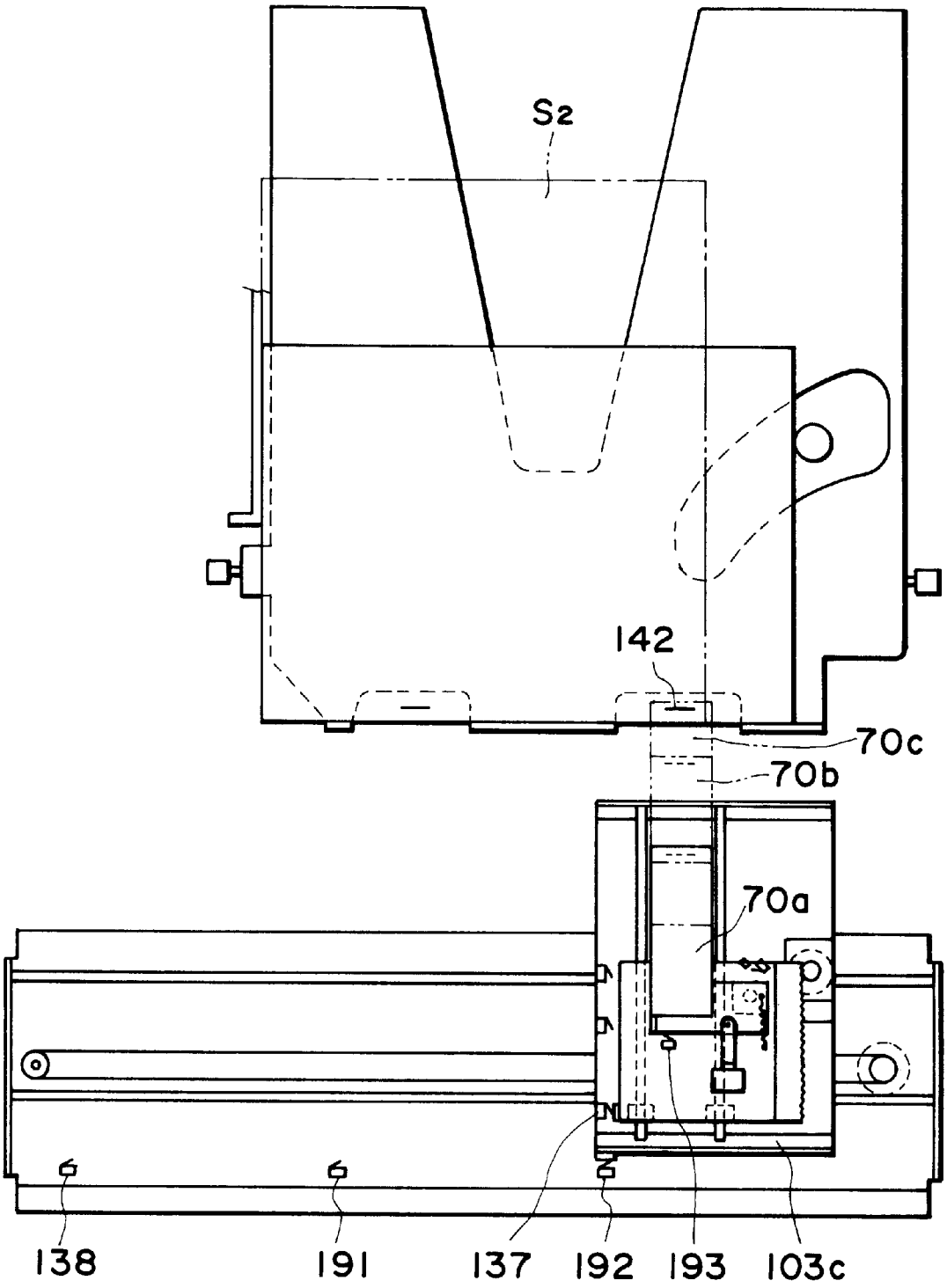
FIG. 13 is a plan view of the bin and stapler portions, depicting the stapling operation.

Next, the motor 130 is rotated counterclockwise (S228) to move the third supporting member 103 to the location 103*c*. The presence of the third supporting means 103 at the location 103*c* is detected by the detecting means 192 (S230) (FIG. 13).

With the third supporting member 103 being at the location 103*c*, the motor 123 is clockwise rotated (S231) to move the second supporting member 102, that is, to move the stapler 70 from the location 70*b* to the location 70*c*, and is stopped (S233) after the presence of the stapler 70 at the location 70*c* is detected by the detecting means 199 (S232). Here, a staple is struck into the sheets, at a point H, that is, the second binding point of the double-point binding mode (S234). Since this operation is the single bin operation (S234), the motor 123 is counterclockwise rotated (S226) to move the stapler 70 from the location 70*c* to the stand-by location 70*a*, and is stopped (S338) after the presence of the stapler 70 at the location 70*a* is detected by the detecting means 137 (S337), completing thereby the single bin operation.

When it is detected by the detecting means 137 that the second supporting means is at the stand-by location, the motor 53 is clockwise rotated (S239) to return the path end portion 52 to the location 52*a*, and is stopped (S241) after the presence of the path end portion 52 at the location 52*a* is detected by the detecting means 60 (S240).

Next, a description is given as to the binding operation involving two or more bins B.

First, the third supporting member 103 is moved to the location 103*b* (illustrated by a solid line in FIG. 11) to bind the sheets in the last bin into which the sheet has been discharged, at a point 140 (stapler 70 from the location 70*a* to the location 70*c*).

Then, after steps S201 to S220 are carried out, the motor 123 is rotated counterclockwise (S221) to move the stapler 70 from the location 70*c* to the location 70*b* (FIG. 12), and is stopped (S223) after the presence of the stapler 70 at the location 70*b* is detected by the detecting means 199 (S222).

Then, at the completion of the same bin shifting operation as the one described before (S224), the aforementioned operation (moving the stapler 70 from the location 70*a* to location 70*c* to location 70*b*) is repeated to bind the sheets in each of the bins, the number of which corresponds to the number of copy sets, at the point 141, till the binding at the point 141 is completed.

Next, with the stapling apparatus being still at the location corresponding to the last bin in which the sheets have been bound at the location 141, the third supporting member is moved to the location 103*c* (FIG. 13) (S220–S230) as described previously.

Then, at this location, the stapler 70 is moved from the location 70*b* to the location 70*c*, where the sheets are stapled (S231–S232), and the motor 123 is rotated counterclockwise (S242) to return the stapler 70 to the location 70*b* (S242), and is stopped (S244) after the presence of the stapler 70 at the location 70*b* is detected by the detecting means 198 (S243).

Next, the bins are shifted in the direction opposite to that of the preceding shift (S245), the routine steps (movement of the stapler 70 from the location 70*b* to location 70*c* to location 70*b*) are repeated in coordination with the bin shifting operations to continue the binding operations (S231–S234).

After the sheets in the last bin (the first bin in which the sheets are bound at the point 141) are bound at a point 142 (S235), the stapler 70 is returned to the location 70*a*, ending thereby the double-point binding operation involving two or more bins (S226, S237, S238).

Then, the third supporting member 103 is moved leftward from the location 103*c* to the location 103*a* with a predetermined timing, and as the presence of the stapler 70 at the location 70*a*, that is, as the presence of the second supporting member 102 at the stand-by location is detected by the detecting means 137, the path end portion 52 is returned to the sheet discharging location (52*a*), and the returning of the path end portion to this location is detected by the detecting means 60 (S239–S241).

When the return of the second supporting means 102 to the stand-by location is not detected by the detecting means 137, the movement of the path end portion 52 is prohibited.

Incidentally, referring to FIG. 3, it is needless to say that the detecting means 60 and stapler 70 are disposed so as not to interfere with each other in the thrust direction (direction perpendicular to the surface of the drawing).

<Single Point Rear Binding Mode>

As a signal for binding the sheets at a single rear point (binding the sheets discharged to be oriented as indicated by a reference code S2 in FIG. 13, at the point 142) is sent in by the controlling means (S301), the solenoid 116 is activated (S302) just as in the case of the preceding double-point binding operation, whereby the stapler 70 comes to be positioned as shown in FIG. 13. The presence of the stapler 70 at this location is detected by the detecting means 193 (S303).

Then, the presence of each member at its retract position is detected by the detecting means 138 or 137 (S304, S306) in the same manner as in the preceding binding operation, wherein when not detected, each member is returned to the stand-by location (S305, S307). Next, the motor 130 is rotated counterclockwise (S308) to move the third supporting member 103 to the location 103*c*, and is stopped (S310) when the presence of the third supporting means 103 at the location 103*c* is detected by the detecting means 192 (S309).

In the same manner as in the preceding double-point binding mode, after the presence of the path end portion 52 at the location 52*a* (S311) is detected by the detecting means 60, the motor 50 is rotated counterclockwise (S312) to move the path end portion 52 to the location 52*b*, and is stopped (S314) when the presence of the path end portion 52 at the location 52*b* is detected by the detecting means 163 (S313).

As for the ordinal relation among the movements of the path end portion 52, and the first, second, and third supporting members, any order is acceptable.

As soon as it is confirmed by the detecting means 192, 193, 137, and 163, in the same manner as in the binding mode described before, that all the members are at their relevant locations, a signal allowing their movements is issued (S315), whereby the motor 123 is clockwise rotated (S316) to move the second supporting member 102 to the stapling location, that is, to move the stapler 70 from the location 70*a* to the location 70*c*, and is stopped (S318) after the presence of the stapler 70 at the location 70*c* is detected by the detecting means 198 (S317), where the sheets are bound at the point 142 (S319). In the case of the single bin mode (S320), the motor 123 is rotated counterclockwise (S321) to move the stapler 70 to the location 70*a*, and is stopped (S323) after the presence of the stapler 70 at the location 70*a* is detected by the detecting means 137 (S322), concluding thereby this mode. When the presence of the path end portion 52 at the location 52*b* is not detected by the detecting means 163, the movement of the second supporting member 102 to the stapling location is prohibited.

When it is detected by the detecting means 137 that the second supporting means is at the stand-by location, the motor 53 is rotated clockwise (S323), whereby the path end portion 52 is returned to the location 52*a*. Then, after the presence of the path end portion 52 at the location 52*a* is detected by the detecting means 60 (S324), the motor 53 is stopped (S325).

Here, when the presence of the second supporting member at the stand-by location is not detected by the detecting means 137, the movement of the path end portion is prohibited.

Next, the binding operation involving two or more bins B will be described.

In the same manner as in the preceding binding operations, the third supporting member 103 is moved to the location 103*c*; the path end portion 52, to the location 52*b*; and the stapler 70, from the location 70*a* to the location 70*c*, in the same manner as in the case of the single point front binding mode described hereinbefore, where the sheets are stapled (S301–S320). Then, the motor 123 is counterclockwise rotated (S326) to move the stapler 70 to the location 70*b*, and is stopped (S328) after the presence of the stapler 70 at the location 70*b* is detected by the detecting means 199 (S327).

After the sheets in the first bin is bound at the point 142, the bins are shifted one interval (S329), and the sequence of moving the stapler 70 from the location 70*b* to the location 70*c*, stapling the sheets, and returning the stapler 70 to the location 70*b*, is repeated. After a predetermined number of sets of sheets are bound (S316–S320, S326–S329), the stapler 70 is returned to the location 70*a* (S321–S323).

In the same manner as described previously, when the presence of the stapler 70 at the location 70*a* is detected by the detecting means 137, the path end portion 52 is moved back to the location 52*a* (when not detected, the movement of the path end portion 52 is prohibited), and the third supporting member 103 is also moved back to the location 103*a* (S324, S325).

Hereinbefore, the stapling operation modes— single point front binding mode, double-point binding mode, and single point rear binding mode— have been described in combination with the single set binding mode and multiple sets binding mode.

As far as the binding mode is concerned, it may be of a "post-stapling" type in which an unillustrated start button or the like is pressed to start the stapling operation, after the sheets have been sorted and accumulated in the bins; or of a "stapling-sorting" type in which the stapling operation is automatically started after the completion of the sorting operation.

Further, the aforementioned operations may be carried out in a group mode (mode for sorting and accumulating the same copies into the same bin).

<Other Embodiments>

As for the structure of the embodiment of the present invention described so far, the stapler is moved toward the bin of the sorter, to be advanced into the cutaway portion of the bin, where the sheets are bound. However, the same results can be obtained with the use of a different configuration in which the sheets are moved toward the stapler during the stapling operation. Such a configuration will be described hereinafter, referring to FIGS. 14 and 15.

Figure 14:
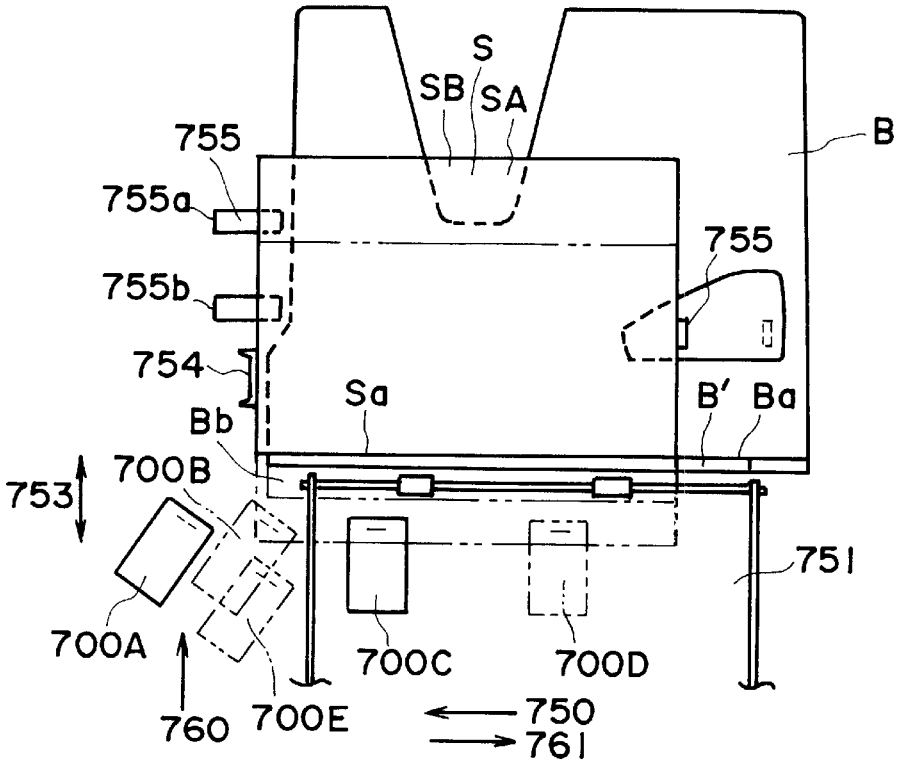
FIG. 14 is a plan view of a sheet post-processing according to another embodiment of the present invention.

The stapler 70 is movable in the direction of an arrow mark 750, wherein it is moved from a stand-by location 700A to a sheet binding locations 700B, 700C and 700D, while changing its orientation to change the staple orientation as illustrated in FIG. 14. However, it is not movable in the direction of an arrow mark 753 from any of the locations illustrated in FIGS. 14 and 15.

The path end portion 751 comprising a discharging roller pair 752 is movable between a sheet discharging location 751*a* where the sheets are discharged into the bin Bb and a retract location 751*b* where it is retracted during the stapling operation. In the state depicted in FIG. 14, the path end portion 751 (positioned at the location 751*a*) and stapler 700 (positioned at the location 700B) are disposed so as not to interfere with each other in the direction of the arrow mark 750.

The sheets S on the bin B are aligned with the use of a reference wall 754, a jogging member 755, and a bin stopper.

When the stapling operation is carried out, a bin stopper B' is retracted from a jogging location B'a to a retract location B'b after the sheet S are held by a gripper 755 at an illustrated point. Then, the gripper 755 is moved from a location 755*a* to a location 755*b*, whereby the sheets S are moved from a location SA to a location SB, advancing a sheet edge Sa into the stapling location. After the sheets S are stapled, they are returned to the location SA on the bin. At this time, the bin stopper B' is also returned to the location B'*a*.

In the sorter having the configuration described in the foregoing, the stapler 700 is at the stand-by location 700A while the sheets are discharged into the bins, and at this time, the path end portion 751 discharges the sheets in the bins at the location 751*a*.

When the sheets are going to be stapled, the path end portion 751 is moved from the location 751*a* to the location 751*b*, and then, the stapler 700 is moved from the location 700A to one of the stapling locations 700B–700D. After the movement of the stapler 700, the sheets S are moved by the gripper 755 toward the stapler, and stapled there.

This configuration also allows the discharging bin and stapling bin to be the same. In addition, in this modified embodiment of the present invention, it is not required to advance the stapler between the bins. In other words, the interval between the discharge bin Bb and the bin Bc immediately below has only to be just enough to prevent the interference between the bins Bb and Bc during the sheets movement; therefore, the interval can be further reduced, enabling thereby the apparatus to be more compact.

Further, when the structure is modified in the following manner: the stapler 700 is kept at the stand-by location 700E, where it does not interfere with the path end portion 751 and sheets S while the path end portion 751 delivers and discharges the sheets S at the location 751*a*, and then, it is moved in one of the directions of arrows 750 and 760 to carry out the same operations as described in the foregoing; the stapling operation at the location 700B (single point front binding mode) can be carried out while the path end portion 751 remains at the location 751*a* (without being retracted).

Also in this case, when the stapler 700 is moved from the stand-by location to the locations 700C or 700D, it is of course acceptable for the stapler 700 to be moved from the location 700E, first, in the direction of an arrow 761, and then, in the arrow 760 direction.

Further, the apparatus further comprises: stapler stand-by location detecting means for detecting the presence of the stapler 700 at the stand-by location 700A or 700E; stapling location detecting means for detecting the presence of the stapler 700 at the stapling location 700C or 700D, where the stapler 700 in the stapling operation interferes with the path end portion 751 if the latter is at the location 751*a*; discharge detecting means for detecting the presence of the path end portion 751 at the discharging location 751*a*; and retract location detecting means for detecting the presence of the path end portion 751 at the retract location 751*b*; wherein when the presence of the stapler 700 at the location 700C or 700D is detected by the stapling location detecting means, the movement of the path end portion 751 from the location 751*b* to the location 751*a* is prohibited, and when the presence of the path end portion 751 at the discharging location 751*a* is detected, the movement of the stapler 700 from the retract location to the stapling location is prohibited.

When it is detected that the stapler 700 is at the retract location (700A or 700E), the movement of the path end portion 751 from the location 751*a* to the location 751*b* is permitted, and when the presence of the path end portion 751 at the location 751*b* is detected, the movement of the stapler 700 from the retract location to the stapling location is permitted. Therefore, the stapler 700 and path end portion 751 are prevented from interfering with each other during their operations.

Figure 16:
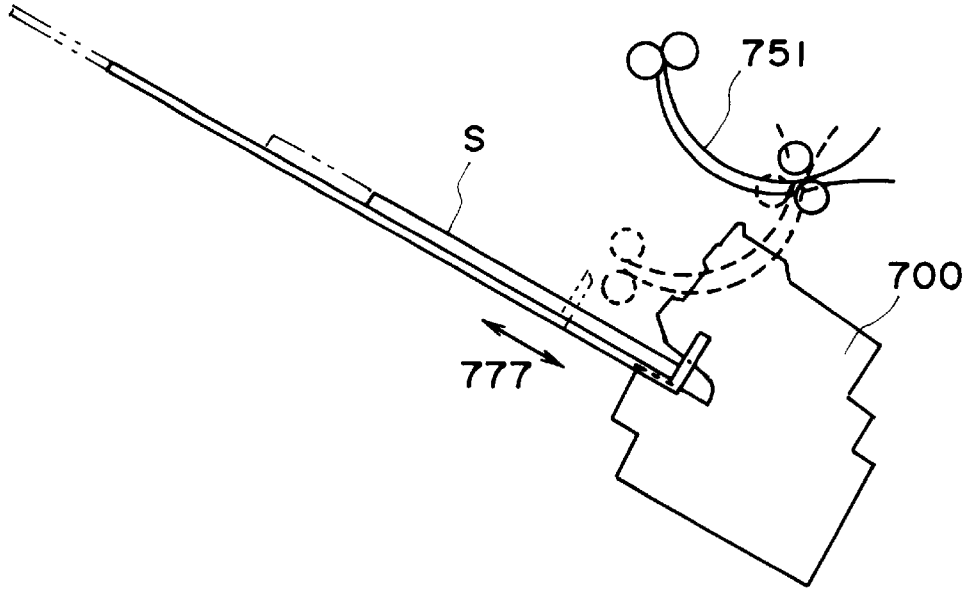
FIG. 16 is a longitudinal section of a portion of the same apparatus adjacent to the stapler portion.

Hereinbefore, the description was given as to the structure by which the sheets alone were moved toward the stapler to be stapled. However, the same results can be obtained with the use of a structure by which the sheets are moved together with the bin toward the stapler (in the direction of an arrow mark 777) (FIG. 16).

Figure 17:
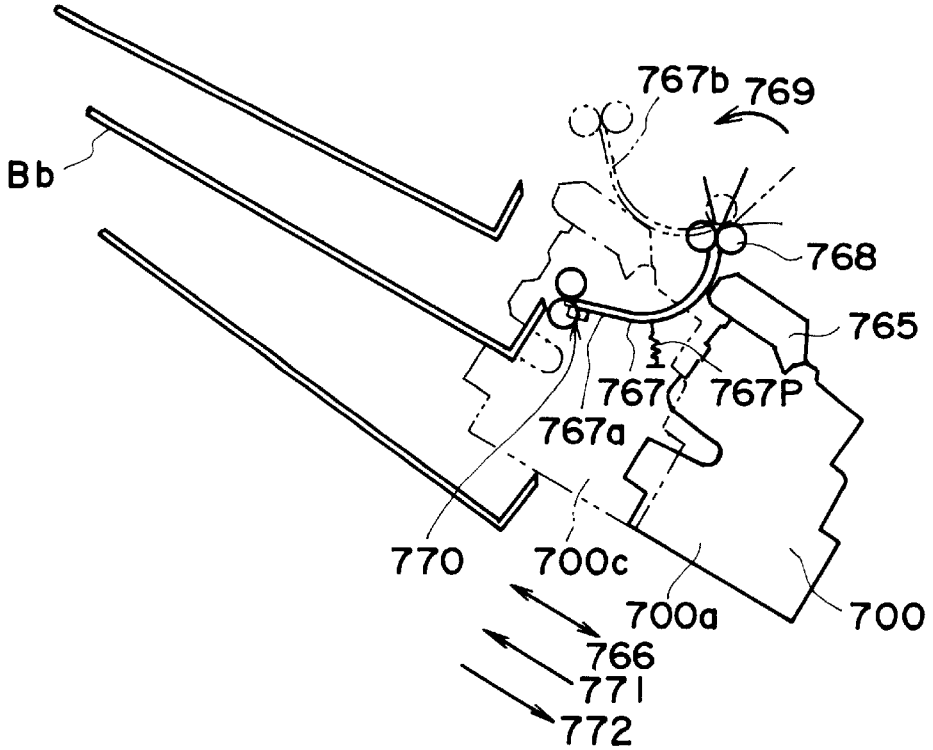
FIG. 17 is a longitudinal section of a portion of the same apparatus adjacent to the stapler portion.

Next, referring to FIG. 17, a modified embodiment of the moving mechanism for the path end portion 767 will be described.

The path end portion 767 is moved by the motor 53 as described with regard to the first embodiment (FIG. 3).

In this embodiment, the movement of the path end portion 767 is linked to the movement of the stapler 700 in the direction of an arrow mark 766.

The path end portion 767 is under the pressure exerted in the direction of an arrow mark 769 from a pressure applying means 767P such as a spring, whereby its tip portion remains in contact with an abutment portion 770 provided on the sorter side; in other words, the path end portion 767 is fixedly disposed at the discharging location where the sheets are discharged into the bin Bb. The abutment portion 770 is disposed so as not to interfere with the stapler in the direction perpendicular to the page of FIG. 17.

Further, a cam member 765 is disposed on the stapler 700. In the case of an apparatus in which the orientation of the stapler 700 is changed in response to the change in the stapling location, this cam member 765 is disposed on the second supporting member 102 (FIGS. 8 and 9).

The stapler 700 and first supporting member 101 (FIGS. 8 and 9) are moved together by the same driving mechanism as the one described previously in the direction of an arrow mark 771, whereby the cam member 765 is brought into contact with the path end portion 767, and pushes it up.

When the stapler 700 is at the stapling location 700C, the path end portion 767 is at the location 767*b* and the sheets are stapled. Then, the stapler 700 is moved by the same driving means as the one described before in the direction of an arrow mark 772 to be returned to the location 700*a*. Meanwhile, the path end portion 767, being under the pressure from the spring 767P in the arrow 769 direction, is moved, being guided by the cam member 765, to the location 767*a*, where it is stopped and held by the abutment portion 770. When the stapler 700 is at the location 700*a*, the cam member 765 is not in contact with the contact portion of the path end portion 767; therefore, the path end portion 767 is accurately positioned by the abutment portion 770.

With the provision of the structure described in the foregoing, there is no need for a path end portion moving motor such as the one described before; therefore, the overall structure can be further simplified. It is of course acceptable to employ different path end portion moving means such as path end portion driving linkage.

Figure 15:
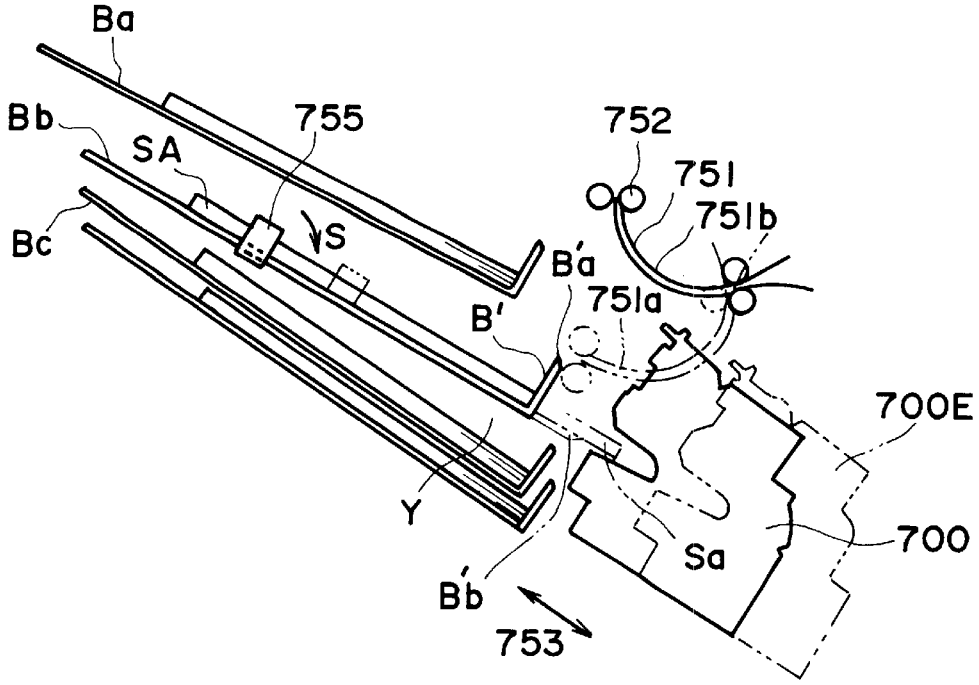
FIG. 15 is a longitudinal section of a portion of the same apparatus adjacent to the stapler portion.

In the preceding embodiment, the movement of the path end portion 767 was linked with the movement of the stapler 700. However, it is quite acceptable to link the movement of the path end portion 767 to the movement of the gripper or the like to retract the path end portion to the retract location, in an apparatus in which the sheets are moved toward the staple 700 as shown in FIGS. 14 and 15.

Figure 18:
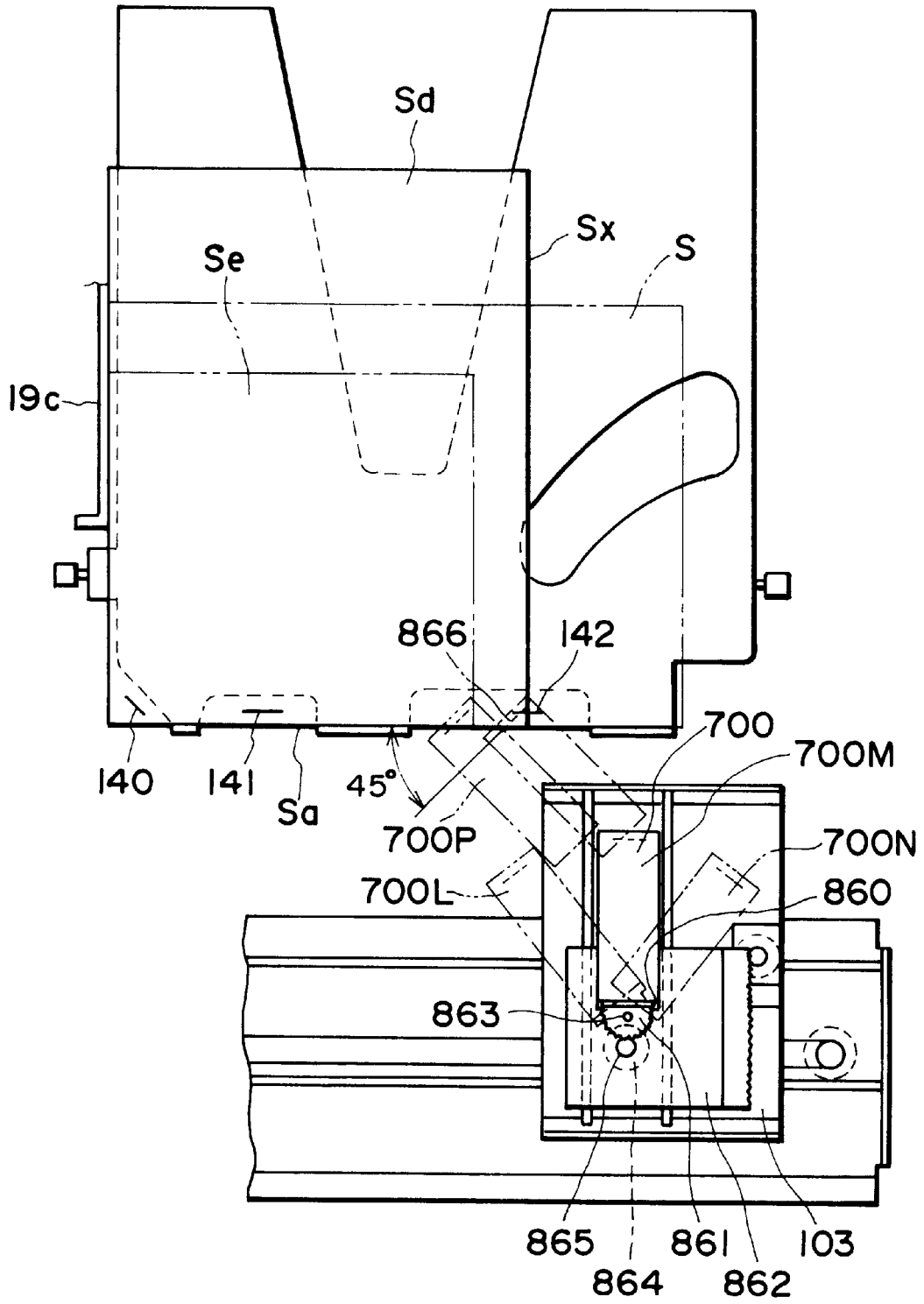
FIG. 18 is a plan view of another sheet post-processing apparatus.

Referring to FIG. 18, an embodiment of a different mechanism for rotating the stapler 700 will be described.

In this embodiment, a gear 861 is provided on the first supporting member 860. The gear 861 is supported in such a manner that it rotates on the second supporting member 862 about an axis 863.

The second supporting member 862 is provided with a motor 864, wherein a driving force is transmitted to the gear 861 by a gear 865 mounted on the motor 864, whereby the first supporting member 860 is rotated with the stapler 700.

Since the rest of the mechanisms are the same as those illustrated in FIGS. 8 and 9, their descriptions are omitted.

When the sheets S are going to be bound at the single front point 140, the stapler 700 is oriented in the direction 700N, and is moved to the stapling location as the third supporting member 103 is moved to a predetermined location, where the sheets S are stapled. In the case of the double-point stapling mode (at the points 141 and 142), the stapler 700 is caused to orient in the direction 700M, and then, the sheets are bound in the same manner.

Now, when the sheets S are bound on the edge Sx side, that is, the side opposite to the reference wall 19*c*, the stapler 700 is oriented in the direction 700L, and then, is moved to a stapling location 866, where the sheets are bound at an angle of approximately 45° relative to the sheet edge as illustrated in the drawing.

With the provision of the aforementioned structure, the sheets can be easily bound even in the single point rear binding mode in which a staple H is placed at an angle.

Further, even when the sheets have a different size (Se), they can be bound at the aforementioned angle by moving the third supporting member to a predetermined location with the stapler 700 being oriented in the 700P direction as shown in the drawing.

It should be noted that this embodiment is applicable whether the structure is such that the stapler is moved toward the sheet set, or that the sheet set, alone or together with the bin tray, is moved toward the stapler.

Figure 19:
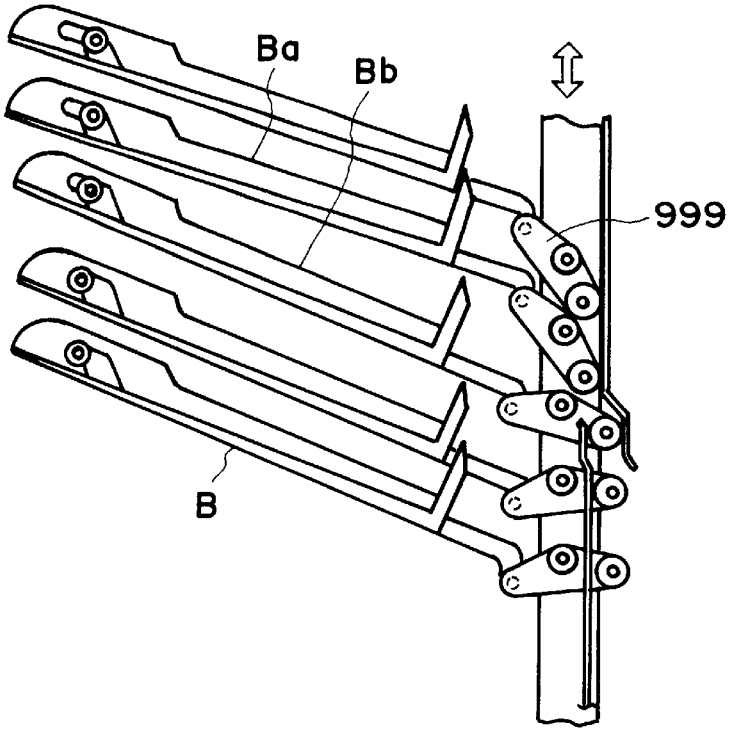
FIG. 19 is a longitudinal section of the essential portion of another sheet post-processing apparatus to which the present invention is applicable.
Figure 20:
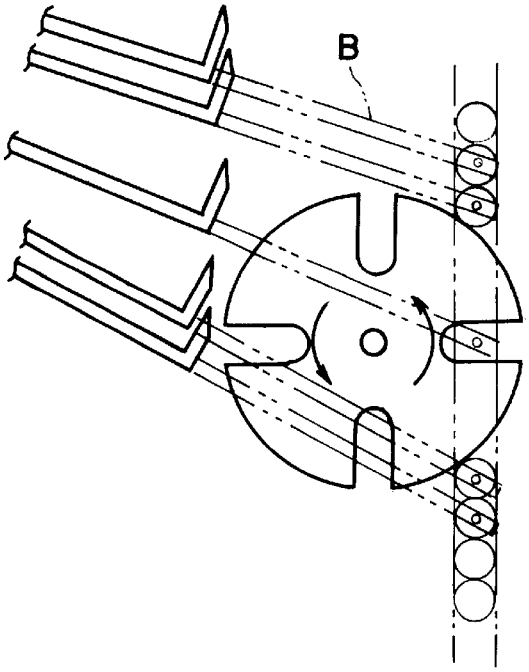
FIG. 20 is a longitudinal section of the essential portion of another sheet post-processing apparatus to which the present invention is applicable.

Hereinbefore, the effects of the present invention were described with reference to the sorter of a type in which the bins are shifted with the use of a lead cam. However, it is needless to say that the present invention is effectively applicable to a sorter of a type in which the bin interval is changed by a linkage 999 illustrated in FIG. 19 (Japanese Laid-Open Patent Application No. 17,063/1983), a sorter of the Geneva type illustrated in FIG. 20 (Japanese Laid-Open Patent Application No. 223,764/1985), or a post-processing apparatus such as a finisher having only a single tray.

Figure 21:
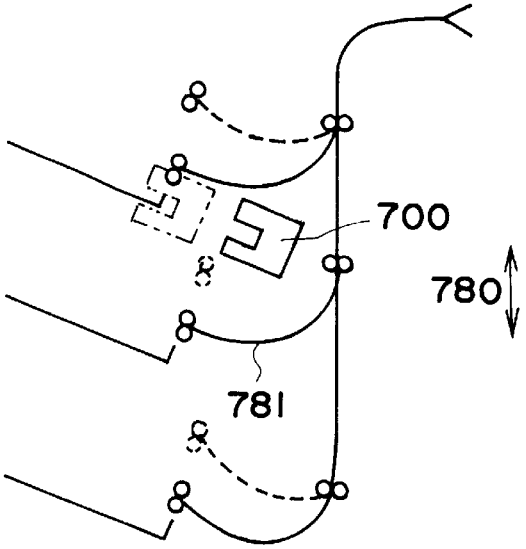
FIG. 21 is a schematic side view of the essential portion of another sheet post-processing apparatus to which the present invention is applicable.
Figure 22:
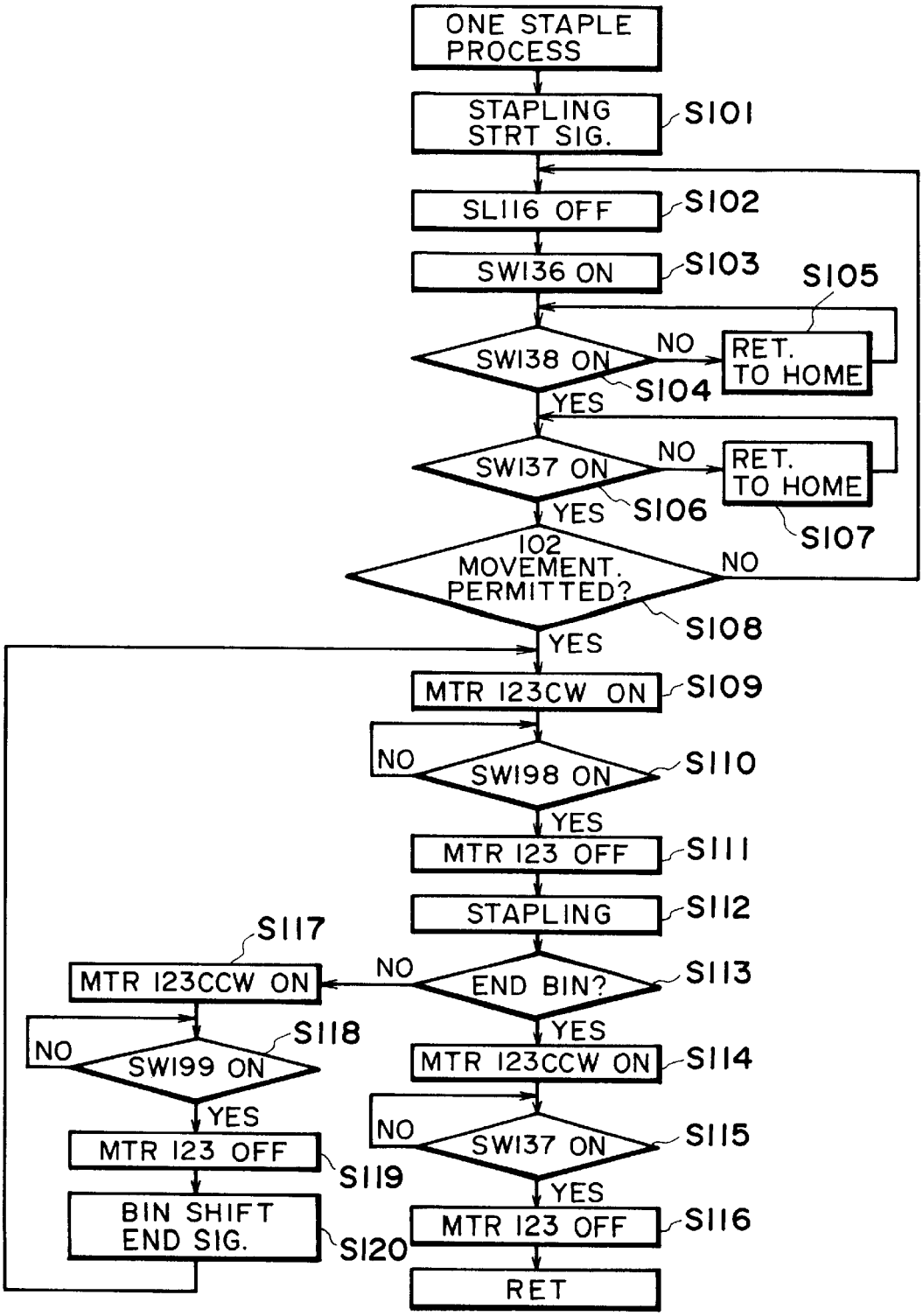
FIG. 22 is a flow chart for the stapling operation of the sheet post-processing apparatus according to the present invention.

Further, the same effects can be obtained when the present invention is applied to a fixed-bin type sorter illustrated in FIG. 21 in which the bins are fixedly disposed, and instead, the stapler is moved in the direction of an arrow mark 780, wherein the path end portion 781 is retracted from this side of the page so that the stapler can be advanced, or the sheets can be pulled out, for the stapling operation.

Figure 33:
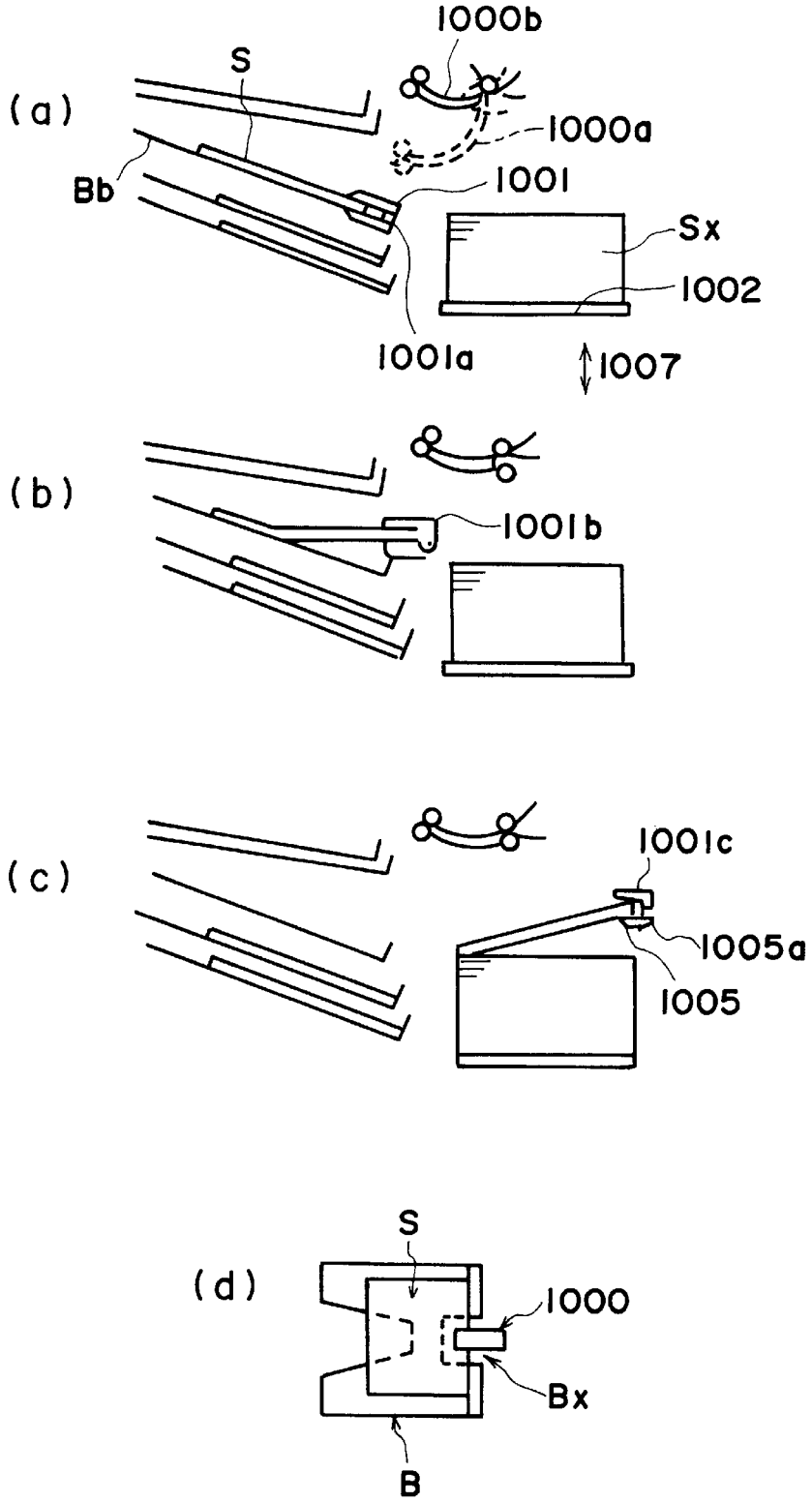
FIGS. 33(*a, b, c, d*) depict alternative driving means for the path end portion (sheet discharging means) according to the present invention: (a) is a side view of the bins, path end portion, and gripper portion; (b) and (c) are side views depicting the operational sequence; and (d) is a plan view of the bin and gripper.

Next, referring to FIG. 33, a description will be given as to another mechanism for moving the path end portion from which the sheets are discharged into the bins.

In this drawing, the path end portion 1000 as the discharging means is movable between a discharging location 1000*a* illustrated by a broken line and a retract location 1000*b* illustrated by a solid line. A gripper 1001 and a stacker 1002 are disposed on the stopper side of the bin B, wherein the gripper 1001 can be advanced toward or moved away from the bin B, and the stacker 1002 is vertically movable in the direction of an arrow mark 1007.

The path end portion 1000 is retracted to the retract location 1000*b* after discharging the sheets S at the discharging location 1000*a*. The gripper having been positioned away from the bin B is advanced into a cutaway portion Bx provided on the bin (FIG. 33(*d*)), where it is caused to grab the sheet set S on the bin B at the location 1001*a* (FIG. 33(*a*)), and then, is moved to a location 1001*b* shown in FIG. 33(*b*), moving thereby the sheet set S to the location 1001*b*.

At this time, the sheet sets S to be grouped may be those having been stapled or those having not been stapled. The sheet sets S to be grouped are further moved from the location 1001*b* to a location above the stacker 1002 shown in FIG. 33(*c*), being sequentially placed on the stacker 1002, where the movable bottom portion 1005 of the gripper 1005 is moved to a releasing location 1005*a*, whereby the sheet sets S are stacked on the stacker 1002.

The movement of the path end portion 1000 to retract location 1000*b* is linked to the movement of the gripper 1001 toward the bin B, through an unillustrated linking mechanism.

As is evident from the description given above, the same preferable effects as those of the preceding embodiment can be obtained even when the path end portion 1000 is moved during the post-processing operation.

While the invention has been described with reference to the structures disclosed herein, it is not confined to the details set forth and this application is intended to cover such modifications or changes as may come within the purposes of the improvements or the scope of the following claims.

What is claimed is:

1. A sheet post-processing apparatus comprising:

at least one sheet receiving bin for receiving sheets;

sheet discharging means for discharging sheets into said sheet receiving bins, said discharging means being provided with a path for guiding the sheet to said sheet receiving means, wherein said path has a fixed portion and a movable portion which is faced to said sheet receiving bin;

post-processing means for post-processing the sheets stored in said sheet receiving bin;

supporting means for supporting said movable portion of said sheet discharging means, for movement between a first location at a discharging location for discharging the sheets into said sheet receiving bin and a second location at a retract location away from the first location; and moving means for moving said movable portion of said sheet discharging means from the first location to the second location when relative movement is imparted between the sheets and said post-processing means so that said post-processing means effects its post-processing operation at a predetermined location along the edges of the sheets in said sheet receiving bins.

2. A sheet post-processing means according to claim 1, wherein said post-processing means is movable substantially in parallel with the sheet edge to allow a post-processing operation to be performed on the sheet, at a predetermined point or points along the sheet edge; and wherein when the post-processing operation is performed on the sheet at least at one corner along the sheet edge, said post-processing means is operated with said movable portion of said discharging means at first location, and when the post-processing operation is performed on the sheet, at substantially the center portion along the sheet edge or at the other corner, said post-processing means is operated with said movable portion of said discharging means at the second location.

3. A sheet post-processing apparatus according to claim 1, wherein said post-processing means take a position at one of (i) a first location where said post-processing means performs the post-processing operation and said post-processing means interferes with said sheet-discharging means if said movable portion of said sheet discharging means has not been moved away, (ii) a second location where said post-processing means does not interfere with said sheet discharging means, and (iii) a third location set up between the first and second locations where said post-processing means does not interfere with said receiving tray and the sheet(s) thereon during the movement of said sheet receiving tray.

4. A sheet post-processing apparatus according to claim 1, wherein said apparatus further comprises first detecting means for detecting the presence of said post-processing means at a post-processing location and second detecting means for detecting the presence of said movable portion of said sheet discharging means at the discharging location, and wherein when the presence of said post-processing means at the post-processing location is detected by said first detecting means, the movement of said movable portion of said discharging means from the retract location to the discharging location is prohibited, and when the presence of said movable portion of said discharging means at the discharging location is detected by said second detecting means, the movement of said post-processing means to the post-processing location is prohibited.

5. A sheet post-processing apparatus according to claim 1, wherein the movement of said movable portion of said sheet discharging means from the first location to the second location is caused by linking-driving means which directly links the movement of said movable portion of said sheet discharging means and the movement of said post-processing means, relative to the sheets, for performing the post-processing operation with each other.

6. An apparatus according to claim 5, wherein said movable portion of said sheet discharging means has a swingable guiding plate and a roller at an end thereof, and said post-processing means includes a member, formed in said stapler, for urging said movable portion of said sheet discharging means when said stapler is moved to a stapling position.

7. A sheet post-processing apparatus according to claim 1, wherein said movable portion of said sheet discharging means is moved from the first location to the second location by electromotive means, wherein said electromotive means moves before occurrence of the relative movement in accordance with a signal related to imparting of the relative movement.

8. A sheet post-processing apparatus according to claim 1, wherein said post-processing means is disposed at a location adjacent to said sheet receiving tray, so as to face said sheet receiving tray, on the discharging means side, and to allow said sheet to be advanced toward or moved away from said sheet receiving tray.

9. A sheet post-processing apparatus according to claim 8, wherein said apparatus further comprises a supporting member for supporting rotatively said post-processing means, said supporting means being enabled to move substantially parallel to the edge of the sheets on said sheet receiving tray, on the side where the sheets are post-processed, and wherein after said post-processing means is selectively rotated at a predetermined location adjacent to the sheet edge, the sheets and said post-processing means are moved, relative to each other, in such a direction that the sheet edge crosses into the post-processing location so as for the sheet to be post-processed.

10. A sheet post-processing apparatus according to claim 9, wherein the location where said post-processing means is selectively rotated is adjacent to at least one of the corners of the sheet edge, and the rotational direction of said post-processing means is such that a substantially triangular shape is formed by the two edges of one of the sheet corners to be post-processed and the line of the staple orientation.

11. A sheet post-processing apparatus according to claim 1, wherein a sheet set is moved to the post-processing location.

12. A sheet post-processing apparatus according to claim 1, wherein said receiving tray is moved to the post-processing location.

13. An image forming apparatus comprising a sheet post-processing apparatus according to claim 1, wherein the sheets on which images are formed with the use of image forming means are delivered to said sheet post-processing means to be post-processed.

14. An apparatus according to claim 1, further comprising a plurality of said sheet receiving bins arranged substantially vertical, said plurality of sheet receiving bins being shifted so that each of said plurality of sheet receiving bins are faced to said movable portion of said sheet discharging means, said movable portion having a swingable guide and a roller at an end thereof, and said post-processing means including a stapler for stapling the sheets on said plurality of sheet receiving bins placed adjacent said roller.

15. A sheet post-processing apparatus according to claim 1, further comprising a plurality of said sheet receiving bins, said plurality of sheet receiving bins arranged substantially vertically, said plurality of sheet receiving bins being shifted so that each of said plurality of sheet receiving bins are faced to said sheet discharging means, said post-processing means including a stapler and taking a position at one of a first location at which a post-processing operation is performed and at which said post-processing means interferes with said sheet discharging means if said moving means has not moved said movable portion of said sheet discharging means, a second location where said post-processing means does not interfere with said sheet discharging means, and a third location between the first and second locations at which said post-processing means does not interfere with said plurality of sheet receiving bins and the sheets thereon during movement of said plurality of sheet receiving bins, so that when the sheets on said plurality of sheet receiving bins are to be stapled, said stapler moves between the first location and the third location in accordance with the shifting movement of said plurality of sheet receiving bins.

16. An apparatus according to claim 15, wherein when said stapler takes one of the first location and the third location, said movable portion of said sheet discharging means takes the second location.

17. An apparatus according to claim 1, wherein said movable portion comprises a swingable guide plate having a discharging roller at its end.

18. An apparatus according to claim 1, wherein said moving means comprises a mechanical mechanism for transmitting movement of said post-processing means to said movable portion.

19. An apparatus according to claim 1, wherein said moving means comprises a motor for moving said movable portion.

20. An apparatus according to claim 1, wherein said post-processing means comprises gripping means for gripping and feeding the sheets.

21. An apparatus according to claim 1, wherein said post-processing means comprises a stapler.

22. An apparatus according to claim 21, wherein said stapler is movable toward said receiving bin to staple the sheets.

23. An apparatus according to claim 21, wherein the sheets on said receiving bin move toward said stapler.

24. An apparatus according to claim 1, wherein there are provided a plurality of said sheet receiving bins arranged substantially vertically, and said sheet discharging means being disposed for each of said plurality of said sheet receiving bins, and said post-processing means moves substantially vertically relative to said sheet receiving bins.

25. An apparatus according to claim 1, wherein said movable portion comprises a swingable guide plate having a discharging roller at its end, wherein said post-processing means includes stapler movable between a stapling position and a retracted position, and wherein said moving means constitutes a part of said stapler, and is effective to swing said swingable plate to the retracted position together with the discharging roller in cooperation with movement of said stapler to the stapling position before movement of said stapler to its stapling position.

26. An apparatus according to claim 25, wherein there are provided a plurality of said sheet receiving bins arranged vertically and movable step-by-step to face said discharging roller, wherein said stapler is at such a level so as to staple the sheets in a bin facing said discharging roller.

27. A sheet post-processing apparatus comprising:

at least one sheet receiving bin for receiving the sheets;

sheet discharging means for discharging the sheets into said sheet receiving bins, said discharging means being provided with a path for guiding the sheet to said sheet receiving means, wherein said path has a fixed portion and a movable portion which is faced to said sheet receiving bin;

post-processing means for post-processing the sheets stored in said sheet receiving bin;

supporting means for supporting said movable portion of said sheet discharging means, for movement between a first location for discharging the sheets into said sheet receiving bin and a second location at a retracted location distance away from the first location; and moving means for moving said movable portion of said sheet discharging means from the first location to the second location in cooperation with movement of said post-processing means.

28. An apparatus according to claim 27, wherein said movable portion comprises a swingable guide plate having a discharging roller at its end.

29. An apparatus according to claim 27, wherein said moving means comprises a mechanical mechanism for transmitting movement of said post-processing means to said movable portion.

30. An apparatus according to claim 27, wherein said post-processing means comprises a gripping means for gripping and feeding the sheets.

31. An apparatus according to claim 27, wherein said post-processing means comprises a stapler.

32. An apparatus according to claim 31, wherein said stapler is movable toward said receiving bin to staple the sheets.

33. An apparatus according to claim 31, wherein the sheets on said receiving bin move toward said stapler.

34. An apparatus according to claim 27, wherein there are provided a plurality of said sheet receiving bins arranged substantially vertically, and said sheet discharging means being disposed for each of said bins, and said post-processing means moves substantially vertically relative to said sheet receiving bins.

35. An apparatus according to claim 27, wherein said movable portion comprises a swingable guide plate having a discharging roller at its end, wherein said post-processing means includes a stapler movable between a stapling position and a retracted position, and wherein said moving means constitutes a part of said stapler, and is effective to swing said swingable plate to the retracted position together with the discharging roller in cooperation with movement of said stapler to the stapling position.

36. An apparatus according to claim 35, wherein there are provided a plurality of such sheet receiving bins arranged vertically and are movable step-by-step to face said discharging roller, wherein said stapler is at such a level so as to staple the sheets in a bin facing said discharging roller.

37. A sheet post-processing apparatus comprising:

at least one sheet receiving bin for receiving the sheets;

sheet discharging means for discharging the sheets into said sheet receiving bins, said discharging means being provided with a path for guiding the sheet to said sheet receiving means, wherein said path has a fixed portion and a movable portion which is faced to said sheet receiving bin;

post-processing means for post-processing the sheets stored in said sheet receiving bin;

supporting means for supporting said movable portion of said sheet discharging means,for movement between a first location at a discharging location for discharging the sheets into said sheet receiving bin and a second location at a retracted location distance away from the first location; and moving means for moving said movable portion of said sheet discharging means from the first location to the second location to permit said post-processing means to move to its operating position.

38. An apparatus according to claim 37, wherein said moving means comprises an electromotive means, and wherein said post-processing means moves to its operative position when it is detected that said movable portion reaches the retracted location.

39. An apparatus according to claim 38, wherein said movable portion comprises a swingable guide plate having a discharging roller at its end.

40. An apparatus according to claim 38, wherein said post-processing means comprises a gripping means for gripping and feeding the sheets.

41. An apparatus according to claim 38, wherein said post-processing means comprises a stapler.

42. An apparatus according to claim 38, wherein there are provided a plurality of said sheet receiving bins arranged substantially vertically, and said sheet discharging means being disposed for each of said bins, and said post-processing means moves substantially vertically relative to said sheet receiving bins.

43. An apparatus according to claim 38, wherein said movable part comprises a swingable guide plate having a discharging roller at its end, wherein said post-processing means includes a stapler movable between a stapling position and a retracted position, and wherein said moving means is effective to swing said swingable plate to the retracted position together with the discharging roller before movement of said stapler to the stapling position.

44. An apparatus according to claim 43, wherein there are provided a plurality of said sheet receiving bins arranged vertically and are movable step-by-step to face to said discharging roller, wherein said stapler is at such a level so as to staple the sheets in the bin facing said discharging roller.

* * * * *

UNITED STATES PATENT AND TRADEMARK OFFICE

CERTIFICATE OF CORRECTION

PATENT NO. : 5,909,871

DATED : June 8, 1999

INVENTOR(S) : YOSHIFUMI TAKEHARA

It is certified that error appears in the above-identified patent and that said Letters Patent is hereby corrected as shown below:

FIGURE 23,
"TOW-STAPLE" should read --TWO-STAPLE--.

COLUMN 10,
Line 14, "a" should be deleted.

COLUMN 15,
Line 1, "is" should read --are--.

COLUMN 16,
Line 22, "manner:" should read --manner,--.

COLUMN 19,
Line 41, "means" should read --apparatus--.

COLUMN 21,
Line 8, "vertical," should read --vertically,--.

UNITED STATES PATENT AND TRADEMARK OFFICE

CERTIFICATE OF CORRECTION

PATENT NO. : 5,909,871

DATED : June 8, 1999

INVENTOR(S) : YOSHIFUMI TAKEHARA

It is certified that error appears in the above-identified patent and that said Letters Patent is hereby corrected as shown below:

COLUMN 23,
Line 15, "means,for" should read --means, for--.

Signed and Sealed this

Twenty-third Day of November, 1999

*Attest:*

Q. TODD DICKINSON

*Attesting Officer*

*Acting Commissioner of Patents and Trademarks*